US006820837B2

(12) United States Patent
Long

(10) Patent No.: US 6,820,837 B2
(45) Date of Patent: Nov. 23, 2004

(54) UNWIND SYSTEM WITH FLYING-SPLICE ROLL CHANGING

(75) Inventor: Leslie T. Long, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/326,782

(22) Filed: Dec. 20, 2002

(65) Prior Publication Data

US 2004/0118964 A1 Jun. 24, 2004

(51) Int. Cl.[7] ..... B65H 19/12; B65H 19/16; B65H 19/18

(52) U.S. Cl. ..... 242/554.2; 242/554.5; 242/555.3; 242/559.4; 242/564.5

(58) Field of Search ..... 242/554.2, 554.5, 242/554.6, 555.3, 559.4, 564.5, 559.3, 562

(56) References Cited

U.S. PATENT DOCUMENTS

| | | | | |
|---|---|---|---|---|
| 1,742,029 A | * | 12/1929 | Fallot | 242/559.4 |
| 2,216,286 A | | 10/1940 | Wood | |
| 2,258,298 A | * | 10/1941 | Miller | 242/555.3 |
| 2,617,606 A | | 11/1952 | Whatmore | |
| 3,086,725 A | | 4/1963 | Zernov | |
| 3,123,315 A | | 3/1964 | Couzens | |
| 3,189,293 A | * | 6/1965 | Prager | 242/555.3 |
| 3,315,908 A | | 4/1967 | Wetzler | |
| 3,327,959 A | * | 6/1967 | Link et al. | 242/555.3 |
| 3,430,881 A | | 3/1969 | Ebneter | |
| 3,552,670 A | | 1/1971 | Herman et al. | |
| 3,592,403 A | | 7/1971 | Schmitt et al. | |
| 3,655,143 A | | 4/1972 | Wallis | |
| 3,692,251 A | | 9/1972 | Melead | |
| 3,695,539 A | | 10/1972 | Lindstaedt | |
| 3,740,296 A | | 6/1973 | McDonald | |
| 3,753,833 A | | 8/1973 | Bassett et al. | |
| 3,831,876 A | | 8/1974 | Phelps et al. | |
| 3,858,819 A | | 1/1975 | Butler, Jr. | |
| 4,077,580 A | * | 3/1978 | Lang et al. | 242/554.2 |
| 4,132,371 A | | 1/1979 | Byrt | |
| 4,165,842 A | * | 8/1979 | Mengel | 242/554.6 |
| 4,204,650 A | | 5/1980 | Mengel | |
| RE31,192 E | | 3/1983 | Andreasson | |
| 4,443,291 A | * | 4/1984 | Reed | 242/559.4 |
| 4,466,577 A | | 8/1984 | Focke et al. | |

(List continued on next page.)

FOREIGN PATENT DOCUMENTS

| | | |
|---|---|---|
| DE | 1254451 | 11/1967 |
| FR | 2587313 | 4/1987 |
| WO | WO 9846509 | 10/1998 |
| WO | WO 9932383 | 7/1999 |
| WO | WO 0061482 | 10/2000 |
| WO | WO 0160729 A1 | 8/2001 |
| WO | WO 0164562 A2 | 9/2001 |

OTHER PUBLICATIONS

U.S. patent application Publication No. US 2003/0089817 A1, Publication Date: May 15, 2003 Hanson et al., System and Method For Simultaneously Unwinding Multiple Rolls Of Material.

PCT Search Report dated Jan. 13, 2003.

English Language Patent Abstract of JP Publication No. 11310358, Publication Date Sep. 11, 1999.

English Language Patent Abstract of JP Publication No. 62088756, Publication Date Apr. 23, 1987.

*Primary Examiner*—John M. Jillions
(74) *Attorney, Agent, or Firm*—Dority & Manning, P.A.

(57) ABSTRACT

A roll unwinding system having a kitchen rail, a primary drive assembly, and an elevator assembly is disclosed. The unwinding system stages and positions multiple rolls, which are spliced together on the fly. A method for unwinding sequential rolls of web material that eliminates machine down time for positioning new parent rolls is disclosed. A method for unwinding and splicing the rolls is also disclosed.

100 Claims, 16 Drawing Sheets

U.S. PATENT DOCUMENTS 4,586,673 A 5/1986 Tokuno et al.
4,588,344 A * 5/1986 Burke et al. ..... 242/559.3
4,673,142 A * 6/1987 Keene et al. ..... 242/559.3
4,735,372 A 4/1988 Seki
4,757,951 A 7/1988 Ludszeweit
4,773,609 A 9/1988 Steffen et al.
4,821,973 A * 4/1989 Tafel et al. ..... 242/554.2
4,875,633 A 10/1989 Mochizuki et al.
4,881,695 A 11/1989 Beisswanger
5,025,998 A 6/1991 Hutzenlaub et al.
5,101,701 A 4/1992 Boldrini et al.
5,289,984 A 3/1994 Sohma
5,344,089 A 9/1994 Crowley et al.
5,393,009 A * 2/1995 Neri ..... 242/559.3
5,445,341 A 8/1995 Martin et al.
5,584,446 A 12/1996 Delmore et al.
5,697,575 A 12/1997 Moore et al.
5,709,354 A 1/1998 Blandin et al.
5,709,355 A 1/1998 Kinnunen et al.
5,730,389 A 3/1998 Biagiotti
5,906,333 A 5/1999 Fortuna et al.
6,079,661 A 6/2000 Klimek et al.
6,308,909 B1 10/2001 McNeil et al.
6,533,212 B1 3/2003 Tafel, II

* cited by examiner

UNWIND SYSTEM WITH FLYING-SPLICE ROLL CHANGING

BACKGROUND OF THE INVENTION

In the paper converting industry, large rolls of web material known as parent rolls are rolled up on a reel after a web manufacturing process, such as in the production of tissue and other paper products. The parent rolls are usually transported to an unwind station for unwinding and further processing.

Conventional unwind stations or systems known as "unwinds" are used particularly in bath and towel winder machines for the production of bathroom tissue and kitchen toweling and in interfolder and multifolder machines for individual folded sheet products such as facial tissues, hand sheets, and wipers. The products can be produced in wet or dry forms to fit specific customer needs. In these various machines, the unwinds unwind the parent rolls for calendering, embossing, printing, ply-bonding, perforating and other conversion and finishing operations. Once the web material or sheets of the unwound parent rolls have been subjected to the various conversion and finishing operations, the sheets are re-wound into retail-sized logs, cut, and packaged as consumer-sized rolls.

The typical unwind uses core shafts or plugs to support the unwinding parent roll on an unwind stand. Usually, belts driving on a surface of the parent roll provide unwinding power, whereas center driving has been used mainly in film unwinding. When the parent roll runs out in the typical unwinding operation, the spent parent roll, core, and core shaft must be removed from the machine and each new parent roll positioned on the unwind stand with an overhead crane, cart, tractor, extended level rails, or similar roll positioning device.

Traditional unwinds generally suffer from parent roll change down time, thread-up delays, splicing waste, and/or waste from layers of web left on the core. In bath and towel winders and multifolder and interfolders, for instance, parent roll change down time significantly reduces total available machine run time and requires an expenditure of manpower to change the parent rolls.

For machines that simultaneously unwind multiple parent rolls, the waste and delay problem is even more serious. In the typical multifolder unwind, a lack of a real-time "flying-splice" and inability to individually, automatically change parent rolls within the machine at different times result in delays and unacceptable roll waste. Delays occur when the entire machine is stopped to change out all parent rolls simultaneously and when splicing multiple webs of material together from multiple parent rolls at less than full machine operating speed. Roll waste occurs when some rolls in the machine are not completely unwound but must be changed out when all rolls are changed out during machine stoppage.

Another existing drawback in the industry is that winder, interfolder, and multifolder machines are often limited to their existing "footprint" (e.g., width) due to space and cost limitations. Interfolders and multifolders, for instance, frequently include multiple unwinds installed side by. Current technology for quick roll changing and web splicing includes secondary shuttle unwind stands or turret-type unwind stands that require significantly more complex equipment-and use of floor space. Adding these conventional unwinds requires increasing the footprint of the interfolder. Therefore, such additions are usually impractical and cost prohibitive.

Similarly, due to the large number of unwinds in many multifolders, operator accessibility, floor space utilization, and improvement costs pose problems. Conventional unwinds cannot be added adjacent to existing multifolder unwinds to accommodate formation of 2-ply products without a high capital cost to increase floor space. Hence, machine flexibility is limited and maximum output that can be obtained from a downstream rewinder line is reduced.

Accordingly, there is a need to reduce the time machines are stopped or delayed, to improve efficiency, and to reduce web waste at a reasonable cost.

BRIEF SUMMARY OF THE INVENTION

In general, the present invention provides an unwind system for unwinding relatively large parent rolls of tissue, paper, and similar materials utilizing flying-splice roll changes. The unwind system ("unwind") supports unwinding large rolls of web material while reducing roll change delays and waste. The present unwind also provides operator accessibility needed for multiple unwinds installed on multifolders. Moreover, the unwind permits future growth in roll diameter since the present invention supports driving the parent roll from the center or the surface of the parent roll or both. The component parts of the unwind system with flying-splice roll changing are simple, reliable, and economical to manufacture and use.

In one aspect of the invention, an unwind system includes a kitchen rail, a primary center-drive system, and an elevator assembly. A parent roll is captured, aligned, and held in a run position on the kitchen rail by the elevator assembly and a pivoting center-drive arm of the primary center-drive unwind system. In this aspect, a coreshaft of the parent roll is center-driven using a double-sided timing belt mounted on the pivoting arm. The center-drive pivoting arm minimizes space requirements by limiting a width of the unwind system to substantially a combined 10 width of the parent roll and the kitchen rail. Also in this aspect, a web sheet path of the parent roll facilitates an operator's access for manual thread-up of the web sheet when necessary.

In another aspect of the invention, a method for unwinding a parent roll is provided. The method includes the steps of providing at least one parent roll staged on a kitchen rail at a park position. Another parent roll is positioned in a run position on the kitchen rail between an elevator and a drive arm. As the parent roll in the run position unwinds, a surface belt of a secondary unwind drive contacts the parent roll while the pivoting arm of the primary unwind drive disengages and pivots away from the parent roll. The elevator raises the parent roll to a secondary unwind position while the parent roll in the park position is released and moved to the run position. An operator prepares the new parent roll in the run position for splicing by applying two-sided tape or other adhesive and a splice marker. Further steps of this aspect of the invention include pressing the webs of the removed parent roll and the new parent roll together. The older parent roll web is cut and the splice marker is tracked to automatically remove the splice downstream.

In another aspect of the invention, the elevator and secondary unwind arm assembly can be installed with other types of primary unwind designs to reduce roll change delay time and roll waste.

Other aspects and advantages of the invention will be apparent from the following description and the attached drawings, or can be learned through practice of the invention.

BRIEF DESCRIPTION OF THE DRAWINGS

Further details of the invention may be found in the following detailed description of the invention with the aid of the drawings in which.

Figure 1:
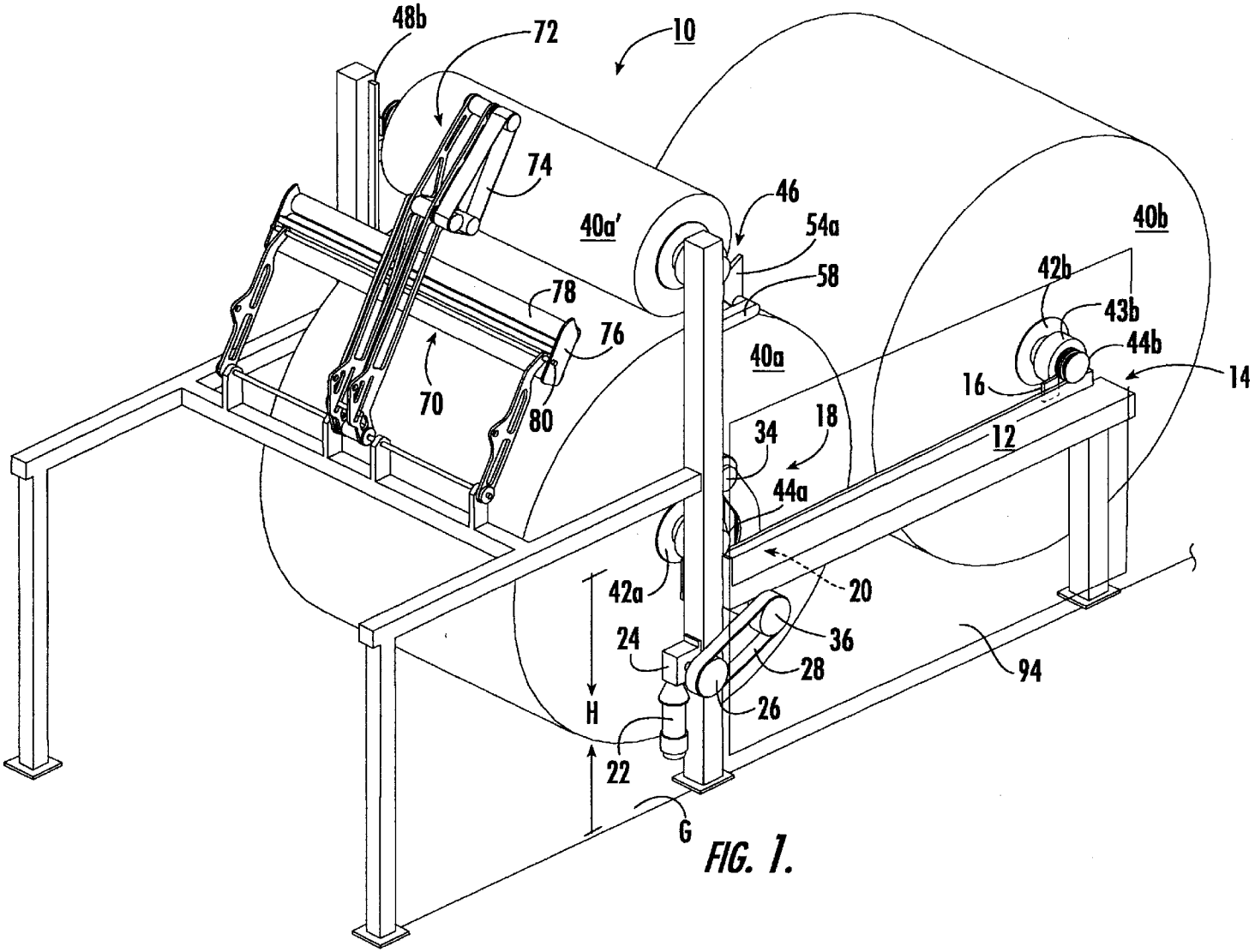
FIG. 1 is a perspective view of an unwind system with a kitchen rail in accordance with an aspect of the invention.

The present specification and drawings use numerical and letter designations to refer to features in the drawings. Like or similar designations have been used to represent same or analogous features or elements of the invention.

DETAILED DESCRIPTION OF THE DRAWINGS

Detailed reference will now be made to the drawings in which examples embodying the present invention are shown. The drawings and the detailed description provide a full and detailed written description of the invention, and of the manner and process of making and using it, so as to enable one skilled in the art to make and use the invention, as well as the best mode of carrying out the invention. However, the examples set forth in the drawings and detailed description are provided by way of explanation of the invention and are not meant as limitations of the invention. The present invention thus includes any modifications and variations of the following examples as come within the scope of the appended claims and their equivalents.

In general, the present invention is directed to an unwind system for unwinding parent rolls of web material using a flying-splice to continuously unwind the parent rolls sequentially and seamlessly. In one aspect of the invention, the unwind system includes a primary center-drive unwind to unwind the parent roll, although a surface-belt unwind may be used in place of or in addition to the center-drive unwind.

Any suitable roll of web material can be unwound with the unwind system of the present invention. For instance, the web material of the parent roll can include tissues, paper towels, industrial wipers, laboratory wipers, wet wipes, nonwoven polymer materials, airlaid materials, wet materials, dry materials, disposable materials, nondisposable materials, treated materials, various other paper products and the like. The unwind system is particularly advantageously used for unwinding large parent rolls of a very soft and high bulk tissue without damaging the tissue. The tissue can be, for instance, a facial tissue or a bath tissue. The tissue can be made predominantly of pulp fibers and can be creped or uncreped. For example, the tissue can be a web creped from a Yankee dryer or, alternatively, can be an uncreped through air-dried fabric.

One embodiment of a suitable high bulk tissue that can be unwound according to the present invention is disclosed in U.S. Pat. No. 5,607,551 to Farrington, Jr., et al. The '551 patent particularly describes soft, high-bulk uncreped through dried tissue sheets. Such tissues can be characterized by bulk values of about 9 cubic centimeters per gram or greater (before calendering), more specifically from about 10 to about 35 cubic centimeters per gram, and still more specifically from about 15 to about 25 cubic centimeters per gram.

The basis weight of paper products processed according to the present invention can vary depending upon the particular application. For instance, when unwinding paper products, the basis weight of the rolled products can range from about 10 pounds (lbs). per ream to about 120 lbs. per ream. Tissue webs typically have a basis weight of below about 50 grams per square meter.

The unwind system of the invention also generally includes one or more roll positioning devices such as kitchen rails. Kitchen rails, for instance, are used to stage or temporarily park one or more parent rolls while operably positioning one or more parent rolls in a run position for unwinding. The kitchen rail is adjacent to an elevator assembly, which assists in positioning the parent roll for unwinding. The elevator assembly further positions the unwinding parent roll, for instance, in a vertical direction, as a secondary unwind or drive system continues to unwind the unwinding parent roll. As the elevator assembly subsequently positions the unwinding parent roll, a new parent roll assumes the run position on the kitchen rail, and the primary center-drive system begins to unwind the new parent roll. It is to be noted that although kitchen rails can be used for staging and positioning parent rolls, other devices such as a positioning arm, described in detail below, are suitable alternatives; thus, the invention is not limited to the exemplary kitchen rail.

Referring to FIGS. 1–13, one embodiment of the unwind system, generally designated by the numeral 10, is shown made in accordance with the present invention. The unwind system 10 includes the kitchen rail 12 operably supporting parent rolls 40*a,b*. In this example, the parent rolls 40*a,b* have an outside diameter (O.D.) of about 55–150 inches, more particularly about 140 inches, and have a width of about 55–110 inches, more particularly about 105 inches. Their roll cores (not shown) have at least an 8-inch inner diameter (I.D.), more particularly about 20 inches I.D., to accommodate coreshafts 42*a,b*, described below. In light of these general examples, it is to be understood that multiple kitchen rails having various orientations and sizes can be provided to accommodate multiple parent rolls of various sizes, laterally, vertically, and/or longitudinally. For instance, as seen in FIG. 1, the kitchen rail 12 can be wide enough to accommodate an opposing wheel (not shown) of another parent roll (not shown) directly opposite wheel 44*a*. Therefore, the additional parent roll can be staged at least temporarily side-by-side or substantially parallel to the parent roll 40*a*.

With more particular reference to FIG. 1, the kitchen rail 12 has a park position 14 (alternatively, staging area or first end) and a run position 18 (alternatively, run area or second end). Notably, multiple park positions can be provided to stage and temporarily store extra parent rolls to minimize resting parent rolls on horizontal surfaces. Resting parent rolls on a floor, for example, may tend to deform the parent rolls due to their size and weight.

The exemplary parent rolls 40*a,b* shown in FIG. 1 are formed of a paper web material W, which exhibits firmness and high strength. Therefore, a helper or a supplemental belt-driven unwind arm (not shown) can be utilized to unwind the web W without damaging a surface of the web W. A center-drive system 20 may be used in place of or in addition to the supplemental belt-driven unwind arm. This aspect of the invention is discussed in greater detail below.

As briefly introduced, the exemplary unwind system 10 of FIG. 1 includes coreshafts 42*a,b*, which are respectively, grippingly inserted in the parent rolls 40*a,b* prior to placing the parent rolls 40*a,b* on the kitchen rail 12. Once inserted, air bladders or expansion chucks (not shown) are inflated or expanded such that the coreshafts 42*a,b* grip the roll cores of the parent rolls 40*a,b*. The coreshafts 42*a,b* rotate freely over bearings (not shown), which are mounted between the coreshafts 42*a,b* and drive sprockets or spindles 43*a*, 43*b*. The grooved wheels or rollers 44*a*, 44*b* are located at each end of the spindles 43*a*, 43*b* to rollingly guide the parent rolls 40*a*, 40*b* from the staging area 14 to the run position 18.

Also shown in the exemplary embodiment of FIG. 1, the unwind system 10 includes a substantially vertical elevator assembly 46 with substantially vertical rails 48*a*, 48*b*, each having respective elevator arms 54*a*, 54*b*. The elevator assembly 46 in this aspect serves both to delineate the run position 18 as well as to vertically position the parent roll 40*a*, as described in operation below.

A guard screen or rail 94 is shown in FIG. 1 to protect operators O or bystanders from inadvertently touching the kitchen rail 12 and related components during an operation of the unwind system 10. The guard screen 94 as illustrated extends from near the ground or floor level G to a walk-up height H, which is between from about 40 inches to about 100 inches above the ground G. Various guard rails, screens, Plexiglas®-type enclosures or similar protective devices are known and suitable for use as guard screen 94. Therefore, further details of the guard screen 94 are not necessary to understand this aspect of the invention and are not provided.

Also shown in FIG. 1 is a tamp assembly or secondary drive unwind 70 with an unwind arm 72 and a secondary surface-drive belt 74. A more detailed discussion of these aspects of the invention is found below.

Figure 2:
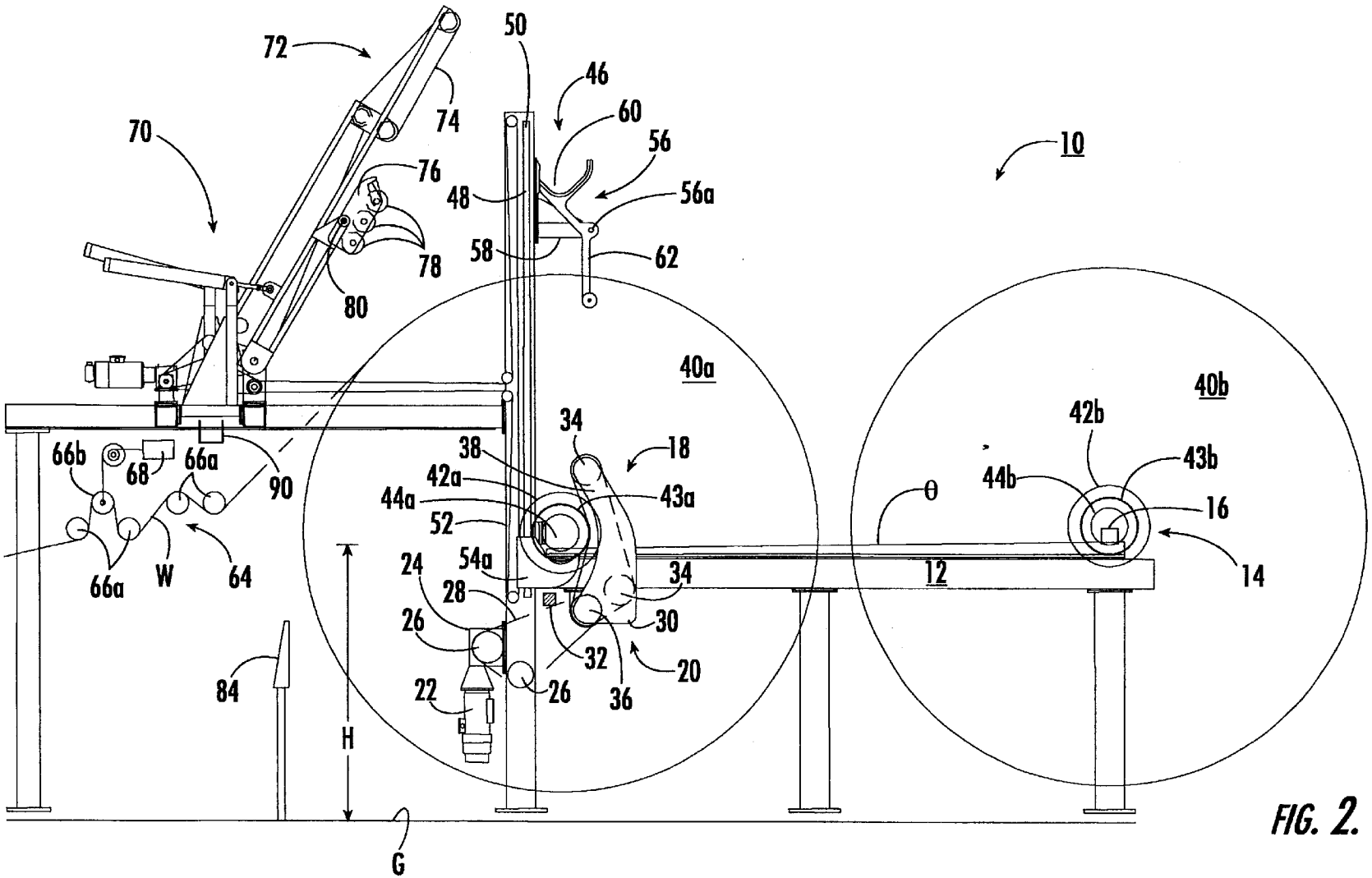
FIG. 2 is an elevational view of an unwind system in accordance with an aspect of the invention.

With particular reference to FIG. 2, a simplified side view of the unwind system 10 in accordance with an aspect of the invention is shown. Certain components are illustrated in phantom or see-through merely for clarity and discussion purposes. As shown in FIG. 2, the unwind system 10 includes the parent roll 40*a* and parent roll 40*b* respectively positioned on the kitchen rail 12 in the run area 18 and staging area 14. As briefly introduced, the coreshaft 42*b* is inserted in the roll core of the parent roll 40*b* prior to delivery of the parent roll 40*b* to the kitchen rail 12. The parent roll 40*b* is positioned at the staging area 14 using an overhead crane, forklift, or similar device. To be clear, it should be noted that a coreshaft (not shown) complementary to coreshaft 42*b* is inserted on an opposite side of the parent roll 42*b*. Alternatively, the coreshaft 42*b* can be a unitary device extending a width of the parent roll 42*b*. In either aspect, expansion chucks or air bladders permit the coreshaft 42*b* to grip the roll core of the parent roll 40*b* as described above.

As shown in FIG. 2, the kitchen rail 12 defines an inclination θ (alternatively, angle or slope), which decreases or declines in the direction of the run position 18 from about 0.25 degrees to about 1.5 degrees. In this example, the parent roll 40*b* is temporarily held in the staging area 14 by a release latch 16. Once the release latch 16 is released, the inclination θ leverages the force of gravity to move the parent roll 40*b*. An example of this operation is described in greater detail below.

Also shown in FIG. 2, a primary drive assembly or unwind system 20 includes a motor 22, a gear reduction box 24, a series of pulleys 26, a synchronous timing belt 28, an adjustable center-drive arm 30, an arm positioning device 32, arm pulleys 34, a pivot pulley 36, and a double-sided synchronous timing belt 38, which may have teeth (not shown) on each side to grip the spindles 43*a,b*. The unwind system 20 in this example is a center-drive system designed for driving relatively large parent rolls 40*a,b* via their center or core by rotation of their coreshafts 42*a,b*. This primary center-drive system 20 is particularly useful to prevent damage to the web W in the case of large, soft parent rolls, such as those formed of tissue webs. Moreover, this center-drive arrangement limits the footprint of the unwind system 10 to an outer edge of the kitchen rail 12, discussed below.

If unwind forces are excessive for a center-drive arrangement, the surface-drive system briefly introduced above can be installed in the vicinity of the run position 18 as a secondary unwind drive to assist the center-drive assembly 20 and reduce stress on the web W. Alternatively, if the parent rolls 40*a,b* are firm and the web W has high strength, the surface belt unwind can be used in place of the center-drive system 20.

In accordance with an aspect of the present invention, the primary center-drive system 20 is located at the walk-up height H above the ground G from between 40 to about 100 inches. The walk-up height H facilitates operator access to the unwind system 10, which will be described in detail below. Also in this aspect, the center-drive assembly 20 minimizes space requirements of the unwind system 10, at least by limiting a width of the unwind system 10 to an outer limit of the kitchen rail 12. Accordingly, other unwind systems 10 can be added side by side without need for operating or maintenance zones between unwind systems.

As shown in FIG. 2, the motor 22 and its related components drive the primary center-drive system 20. More specifically, the center-drive arm 30 of the primary center-drive system 20 is pivotably attached to the unwind system 10 by a pivot pulley 36. The pivot pulley 36, together with the arm-positioning device 32, programmably or manually pivots the center-drive arm 30 into engagement with the spindle 43*a*. The arm-positioning device 32 can be a pneumatic positioning cylinder, a hydraulic device, an electrical device, a mechanical device or the like. As briefly introduced above, the spindle 43*a* is operably connected to the coreshaft 42*a* at one end and to the wheel 44*a* at the other end. The double-sided synchronous timing belt 38 of the center-drive arm 30 engages the spindle 43*a* in this example to drive and unwind the parent roll 40*a*. The double-sided synchronous timing belt 38 may include teeth to engage the spindle 43*a*. The spindle 43*a* can be smooth or have complementary teeth (not shown), which engage the teeth of the timing belt 38. Alternatively, the double-sided synchronous timing belt 38 can be smooth to engage teeth on a surface of the spindle 43*a*. It is intended, therefore, to include alternative center-drive arrangements such as friction drums, flat belts, round or V-belts with various friction and interlocking engagements between the timing belt 38 and spindle 43*a* in order to unwind the parent rolls 40*a,b*.

FIG. 2 further shows the elevator assembly 46 with a vertical rail 48*a* on which an elevator arm 54*a* is slidingly disposed. A secondary run position support or hinged latch assembly 56 is pivotably disposed at a first vertical end 50 of the elevator assembly 46. The hinged latch assembly 56 is pivotably mounted to the elevator assembly 46 by a pivot 56*a* and a horizontal mounting arm 58. The hinged latch assembly 56 includes a cradle 60 and a counterweight 62 that cooperate to receive the unwinding parent roll 40*a*. In this example, the elevator arm 54*a* moves between the first vertical end 50 and a second vertical end 52 that is approximately co-located with the second end 18 of the kitchen rail 12. The elevator arm 54*a* is designed to move above the hinged latch assembly 56 to deliver the unwinding parent roll 40*a* to the cradle 60, which is described in greater detail with respect to FIGS. 3–13 below. It is to be noted that if the elevator arm 54*a* is made pivotable, the pivotable elevator arm 54*a* can be used in place of or in addition to the hinged latch assembly 56.

Also shown in FIG. 2 is an idler roll system 64 which includes rolls 66*a* and a dancer roll 66*b* that cooperate to speed trim the unwind drive motor 22 based on a position of the dancer roll 66*b*. As shown, the web W is routed about the rolls 66*a,b*. By way of example, as the dancer roll 66*b* rises due to the web W loosening, the dancer roll 66*b* communicates a speed reduction to the motor 22. Likewise, when the dancer roll 66*b* moves toward rolls 66*a* indicating that the web W is tightening, the dancer roll 66*b* communicates to the motor 22 to increase speed.

FIG. 2 further shows the tamp assembly or secondary drive unwind 70, briefly introduced above with respect to FIG. 1. The secondary drive unwind 70 includes an unwind arm 72 having a secondary surface-drive belt 74 and a knife and roller arm 76 with idler rolls 78. The idler rolls 78 are movably attached to the unwind arm 72 via a self-aligning pivot 80. In one embodiment, idler rolls 78 are made of lightweight carbon fiber, are freewheeling, and have low inertia to match the unwind speed of the web W. It is possible to motorize the idler rolls 78, although this may increase costs and stresses on delicate tissue webs W.

In the example of FIG. 2, three idler rolls 78 are provided to cover a length on a surface of the web W to splice the ends of the web W together. Although additional or fewer idler rolls 78 can be utilized, three idler rolls 78 have been found to be useful in unwind arrangements that do not calender or emboss the parent rolls 40*a,b*. Calendering and embossing, by default operation, serve to splice or seam webs together. Here, however, a splice or seam 86 is formed in part by a dwell time created by a running of the idler rolls 78. The dwell time is a function of the number of rolls 78 that make contact with the surface of the parent roll 40*a*. A pivot 80 ensures that the three idler rolls 78 self-align on the surface of the web W. If the parent rolls 40 have a relatively small diameter, the self-aligning pivot 80 permits all three idler rolls 78 to contact the surface to splice the ends of the web W together. Conversely, without pivot 80, only the idler roll 78 closest to a small diameter roll may contact the surface, which may result in a less than optimal seam 86.

Figure 3:
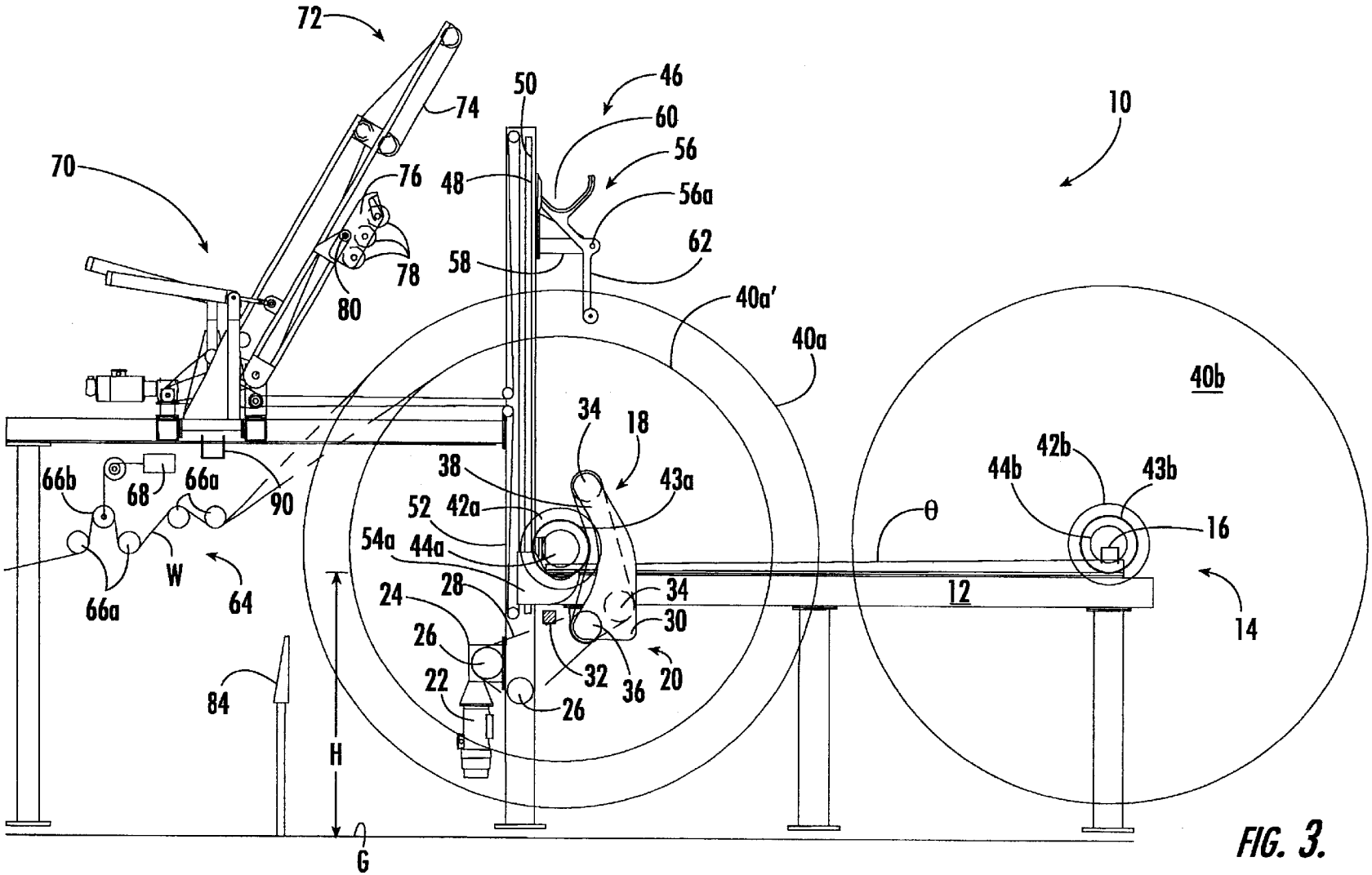
FIG. 3 is an elevational view as in FIG. 2 in which a parent roll in a run position is being unwound by a primary center-drive system.

Now referring to FIGS. 2–13, an exemplary operation of the unwind system is illustrated in sequential views. With regard to FIG. 2 the parent roll 40*a* is in the run position 18 and the parent roll 40*b* is held at the staging area 14 by the release latch 16 until parent roll 40*a* is at least partially unwound. FIG. 3 illustrates parent roll 40*a* being unwound to a smaller roll 40*a*'. It is to be noted that the parent roll 40*a* in the run position 18 is easily accessible by an operator O of average adult height. This is advantageous, for instance, if maintenance is required on certain components of the unwind system 10. The walk-up height H does not require the operator O to climb ladders or other raised platforms that may pose falling hazards.

Figure 4:
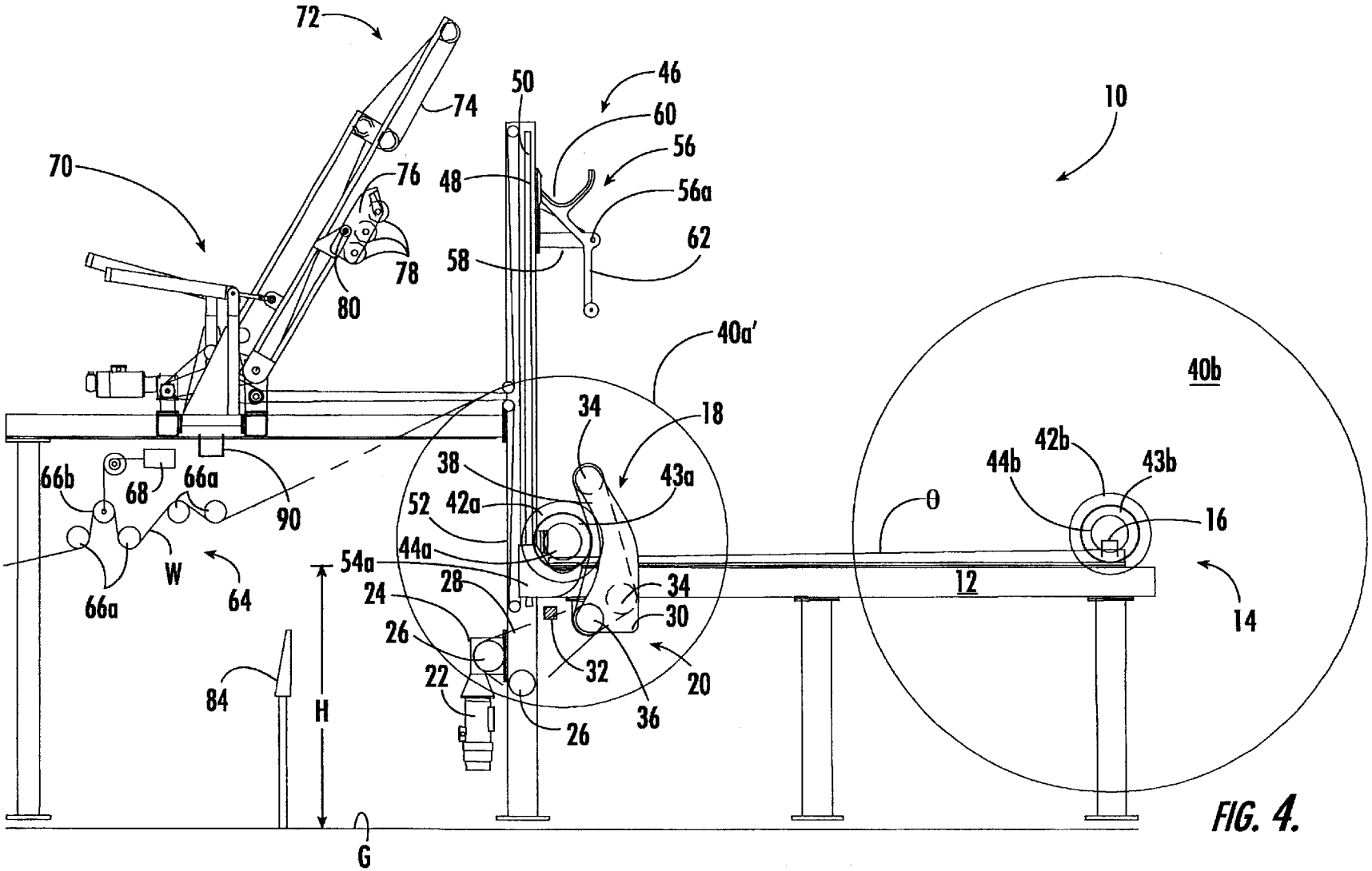
FIG. 4 is an elevational view similar to FIG. 3 in which the parent roll in the run position has been further unwound.
Figure 5:
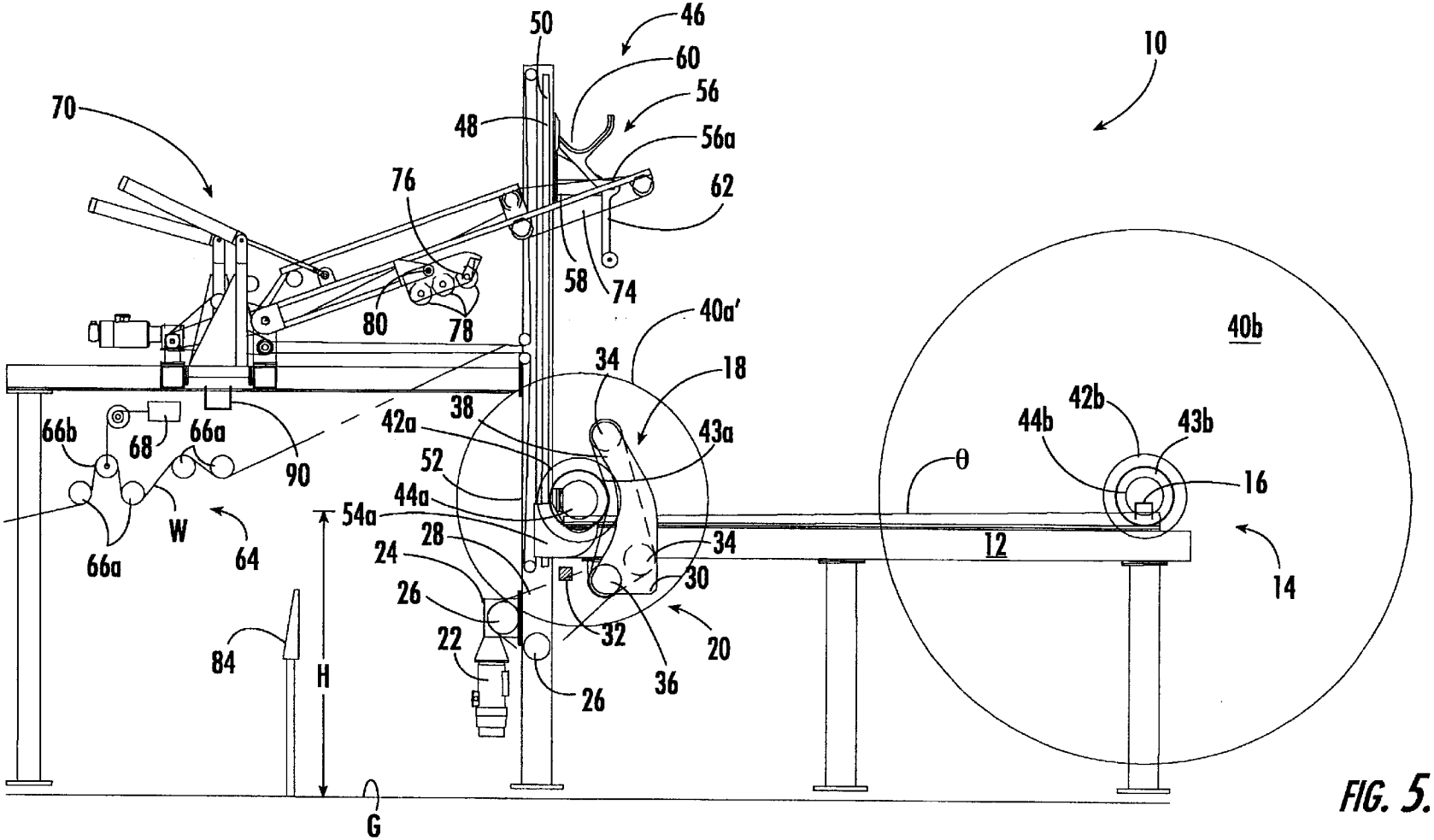
FIG. 5 is an elevational view similar to FIG. 4 in which a secondary drive unwind system is shown moving toward the unwinding parent roll.

As shown in FIGS. 4 and 5, the parent roll 40*a*' continues to unwind and decrease its diameter. FIG. 5 specifically shows the secondary drive unwind 70 moving toward the parent roll 40*a*' to engage the secondary surface-drive belt 74 against the web W of parent roll 40*a'*.

Figure 6:
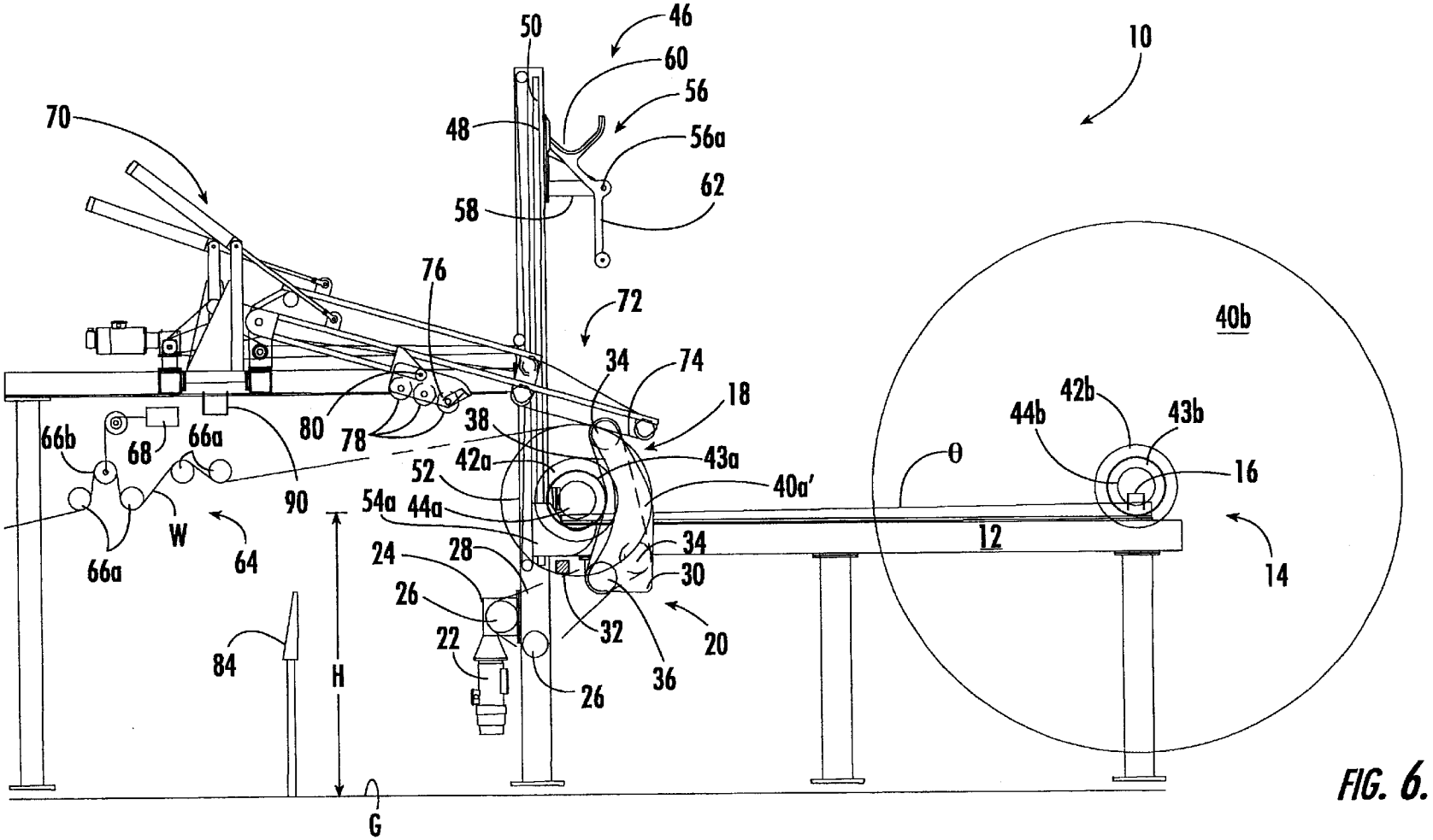
FIG. 6 is an elevational view as in FIG. 5 in which the secondary drive unwind system has engaged the unwinding parent roll.

In FIG. 6, the unwind arm 72 and its secondary surface-drive belt 74 has engaged the web W of parent roll 40*a*'. Surface-drive belt 74 has begun, therefore, to assist in unwinding the web W of the parent roll 40*a*'. It is to be noted that the secondary surface-drive belt 74 is synchronized with the double-sided synchronous timing belt 38 of the primary unwind system 20 to minimize damage to the web W.

Figure 7:
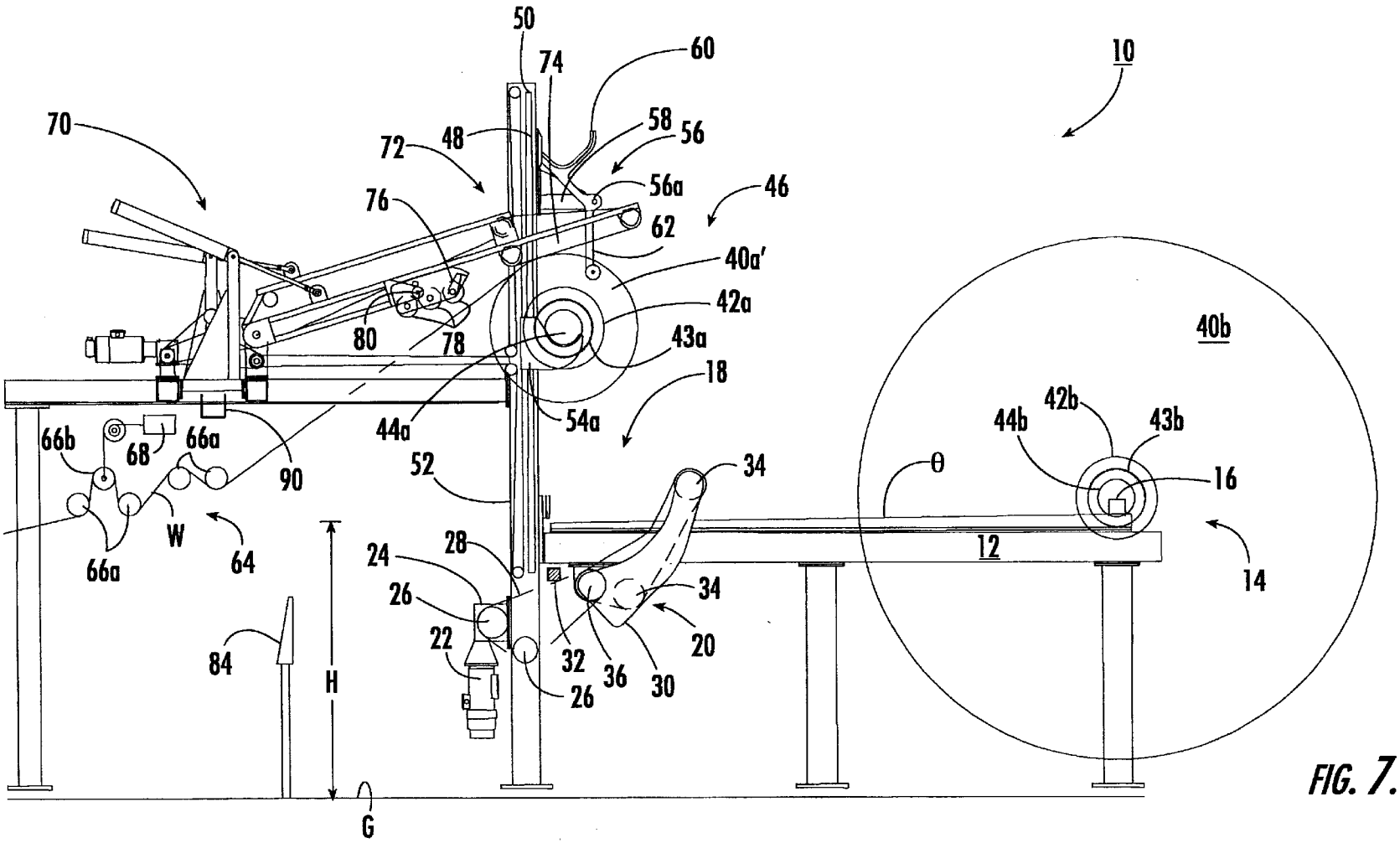
FIG. 7 is an elevational view similar to FIG. 6 in which a drive arm of the primary center-drive system has been disengaged and the secondary drive unwind system and unwinding parent roll are being repositioned along an elevator assembly in accordance with an aspect of the invention.

In FIG. 7, the primary center-drive system 20 is shown disengaging the center-drive arm 30 and pivoting away from the parent roll 40*a*' via the pivot pulley 36. Substantially simultaneously, the elevator arm 54*a* is shown raising the parent roll 40*a*' along the vertical rail 48 in a direction of the first vertical end 50 while the secondary surface-drive belt 74 of the unwind arm 72 continues to unwind the web W.

Figure 8:
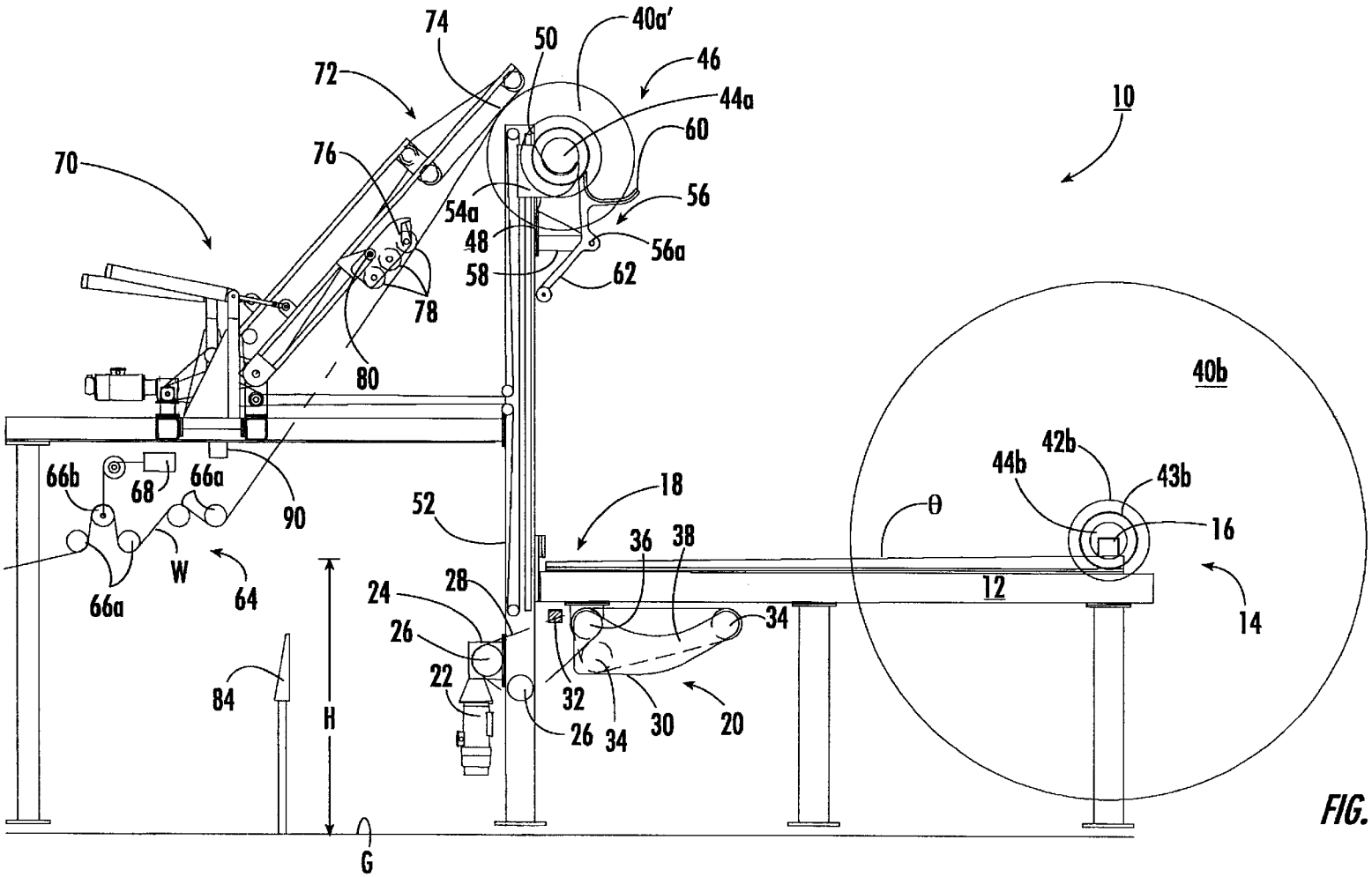
FIG. 8 is an elevational view similar to FIG. 7 in which the unwinding parent roll has been moved past a hinged latch assembly in accordance with an aspect of the invention.

In FIG. 8, the primary unwind drive 20 is shown retracted from a vicinity of the kitchen rail 12 in order for the spindle 43*b* and wheel 44*b* to move unobstructed to the run area 18. Meanwhile, the parent roll 40*a*' continues to be unwound as the elevator arm 54*a* moves toward the first vertical end 50. The elevator arm 54*a* pivots the hinged latch assembly 56 and its cradle 60 away from the elevator assembly 46 as the elevator arm 54*a* nears the first vertical end 50. Also shown in FIG. 8, the idler roll 78 of the knife and roller arm 76 begins to engage the web W.

Figure 9:
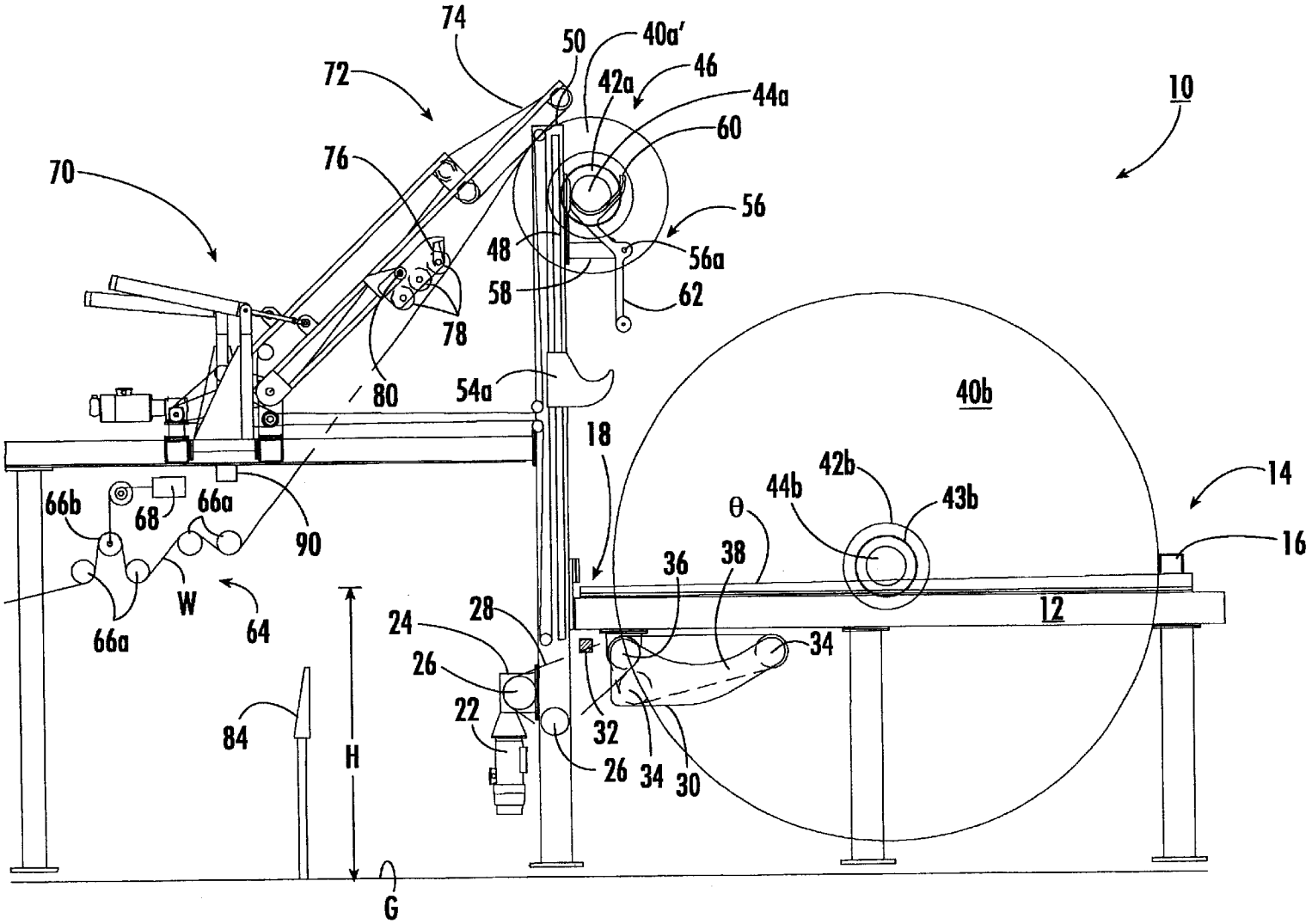
FIG. 9 is an elevational view similar to FIG. 8 in which the hinged latch assembly has engaged the unwinding parent roll.

In FIG. 9, the release latch 16 has been released to allow the parent roll 40*b* to move to the run position 18 along the inclination θ of the kitchen rail 12 due to the force of gravity. The release latch 16 can be a hook and latch device, a pop-up device, a magnet, or similar device to temporarily position and hold the parent roll 40*b* at park position 14 before releasing the parent roll 40*b* toward the run position 18. In this example, the park position 14 is disposed from between about 0.5 degrees to about 1.5 degrees above the run position 18 so that the parent roll 40*b* is gravitationally urged in a direction of the run position 18. It should be noted that the inclination θ is provided by way of example only. For instance, an inclination θ greater than 2 degrees above the run position 18 can be provided if desired to move very large rolls. However, it is to be noted that the elevator assembly 46 may require additional structural support for repeated stops of large rolls using greater inclinations. Alternatively, a substantially horizontal kitchen rail incorporating mechanical, electrical, or other devices can move the parent roll 40*b* to the run position 18 in lieu of or in addition to inclination θ and the force of gravity. In other words, a powered roll transfer system can replace or supplement the inclination θ and gravity. Further, the kitchen rail 12 can be removed altogether in an alternative embodiment, which is described below with respect to FIG. 15.

With further reference to FIG. 9, the counterweight 62 of the hinged latch assembly 56 has gravitationally urged the cradle 60 into a receiving position for the spindle 43*a*. Therefore, the hinged latch assembly 56 is shown returned to a resting position via the counterweight 62, and the cradle 60 has received the unwinding parent roll 40*a*' from the elevator arm 54*a*. Meanwhile, the elevator arm 54*a* is returning to the second vertical end 52 in the run area 18 to receive the incoming parent roll 40*b* for unwinding. It is to be noted that in addition to or in lieu of the gravity-operated counterweight 62, the hinged latch assembly 56 can be pivoted electrically, mechanically, pneumatically, or by manual operation. Also, as previously noted, if the elevator arm 54*a* is made pivotable, the pivotable elevator arm 54*a* can be used in place of or in addition to the hinged latch assembly 56.

Figure 10:
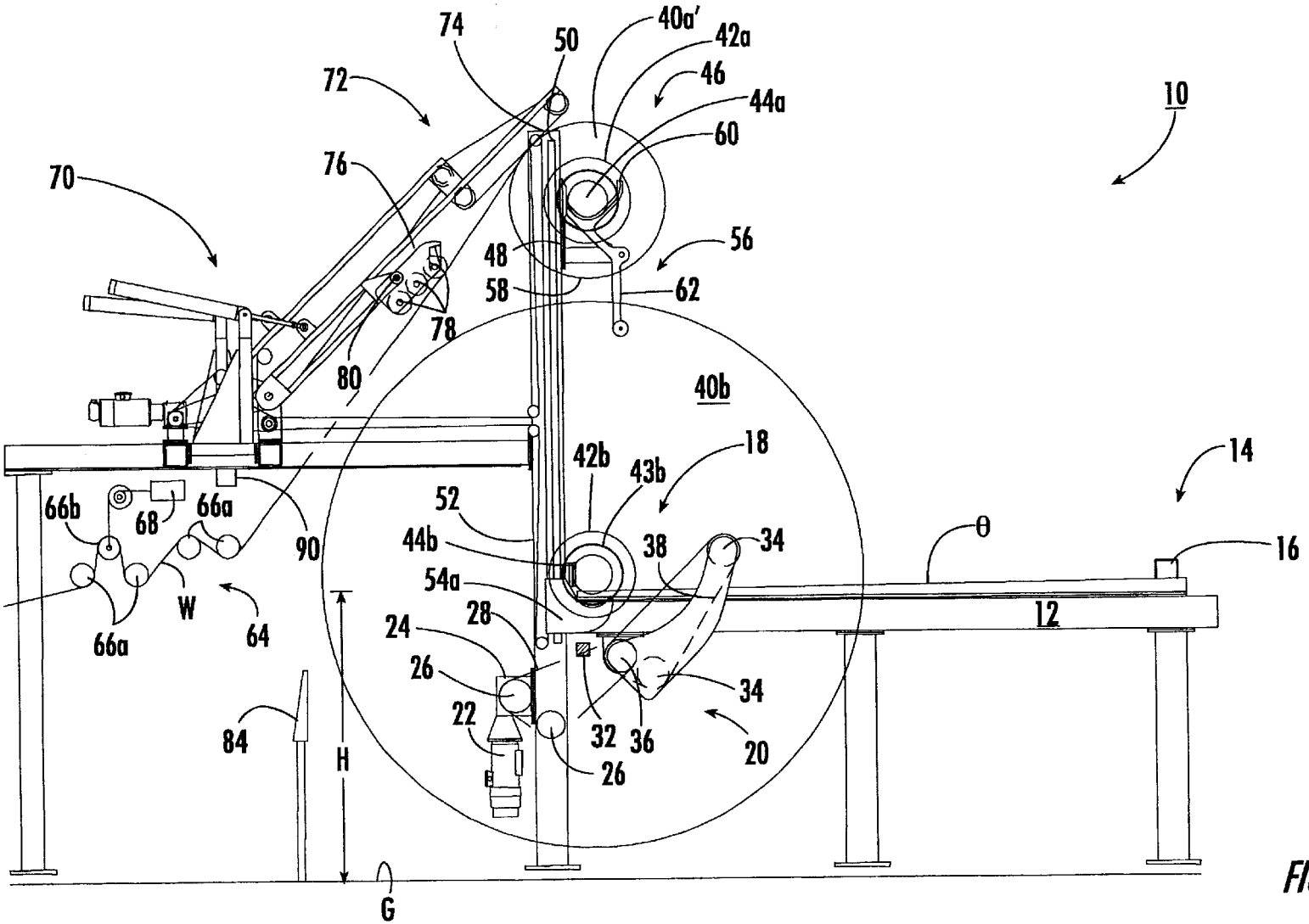
FIG. 10 is an elevational view similar to FIG. 9 in which a new parent roll is in the primary run position.

In FIG. 10, the parent roll 40*b* has rolled against the elevator assembly 46 and vertical rail 48. In some instances, due to a size and weight of the parent roll 40*b*, inclination θ, and gravity, the parent roll 40*b* will rebound slightly from the vertical rail 48 and return a short distance, such as an inch or two, in the direction of the staging area 14. In comparison to shaftless unwind systems, this aspect of the invention during roll changes is not sensitive to roll rebound and alignment. As FIG. 10 illustrates , the center-drive arm 30 pivots to engage the spindle 43*b* to properly position the parent roll 40*b* in the run position 18, which is discussed more fully with respect to FIG. 11 below.

Figure 11:
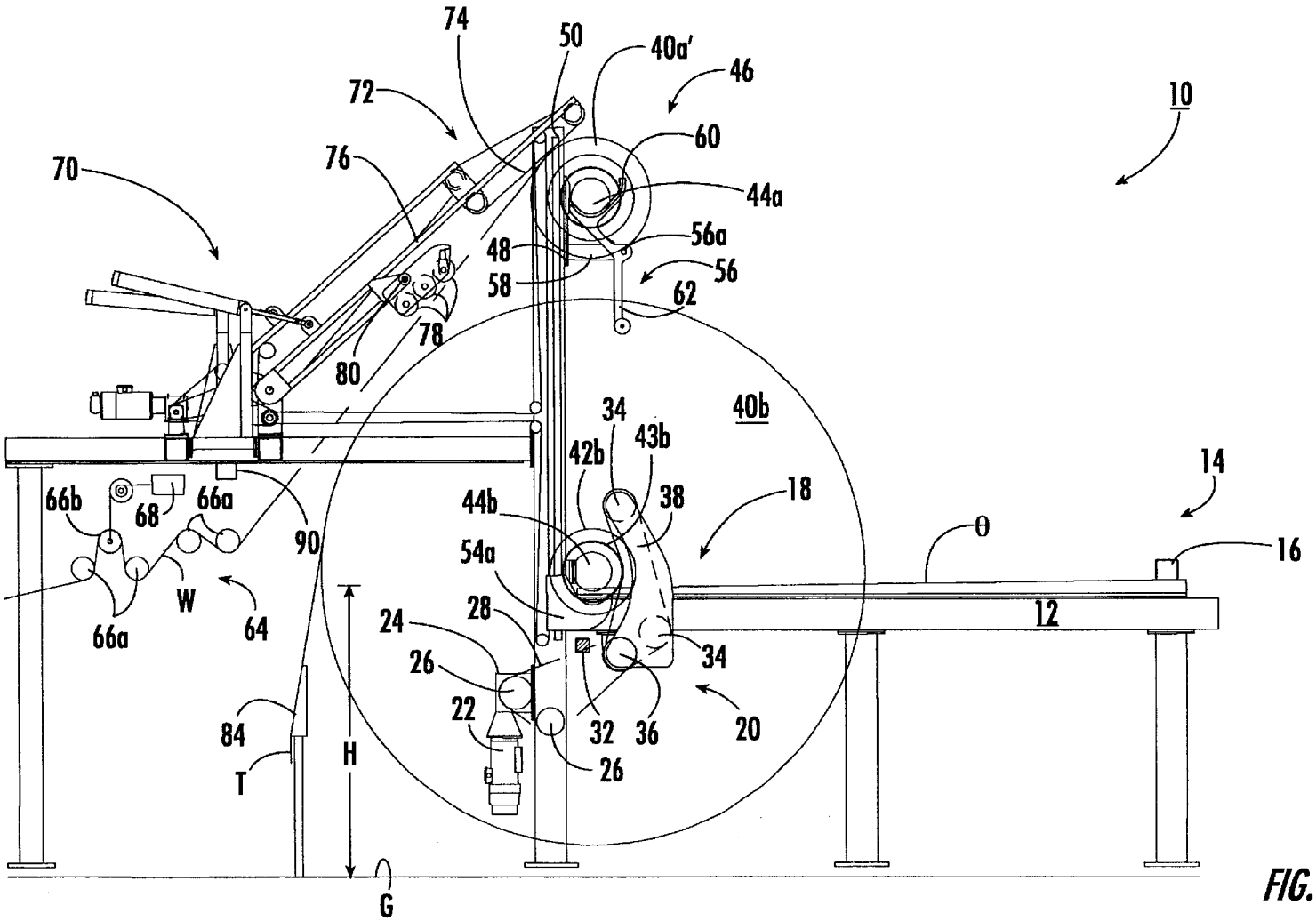
FIG. 11 is an elevational view as in FIG. 10 particularly showing a tail of the new parent roll being prepared.

FIG. 11 shows the parent roll 40*a*' continuing to be unwound by the unwind arm 72 at the first vertical end 50 of the elevator assembly 46. Additionally, the primary center-drive arm 30 has more fully engaged the spindle 43*b* with the double-sided synchronous timing belt 38. As noted with respect to FIG. 10 above, the pivoting engagement of the center-drive arm 30 against the spindle 43*b* adjusts the parent roll 40*b* the inch or two in a direction of the run position 18 to properly position the parent roll 40*b* in the run position 18. More particularly, the coreshaft 42*b* is captured, aligned, and held in the run position 18 on the kitchen rail 12 by the vertical rail 48 on one side and the pivoting center-drive arm 30 on the opposite side of the coreshaft 42*b*. Thus, the center-drive arm and the vertical rail 48 ensure that the parent roll 40*b* is properly positioned in run position 18. It is to be noted that a complementary center-drive assembly can be disposed opposite the center-drive assembly 20 on the opposite side (not shown) of the parent rolls to assist positioning the parent rolls 40*a,b*. Alternatively, an assist device can be utilized in place of a complementary center-drive assembly to assist the center-drive assembly 20 in squaring parent rolls for unwinding. The assist device would help position the parent rolls 40*a,b* in the run position 18, although not necessarily help rotate the coreshafts 42*a,b* to unwind the parent rolls 40*a,b*.

FIG. 11 further shows that the operator O can momentarily jog the parent roll 40*b* at the walk-up height H in order to position a tail T of the parent roll 40*b* on a tail-positioning device 84 such as a vacuum, a blower, a clamp, or other similar device. Here, the parent roll 40*b* is jogged by the operator O to unwind a portion of web W of the parent roll 40*b* toward the tail-positioning device 84 to properly position and prepare the web tail T for a flying-splice with the web W of the parent roll 40*a*'. This flying-splice occurs, for instance, in the following manner:

The operator O prepares the new web W of parent roll 40*b* such that the tail T has an appropriate "feed" geometry. This can be accomplished by cutting the web W at an angle or to a point rather than a square cut across a face of the web W of the parent roll 40*b*. This is typically due to the fact that the parent roll 40*b* may not be perfectly round, despite the relatively circular depictions of parent rolls 40*a,b* in the Figures. Therefore, if the parent roll 40*b* is "egg shaped", a cross cut tail T may help feed the tail T into the idler roll system 64 and to unwind the web W more evenly from the parent roll 40*b*.

The operator O places a marker or flag tape 88 on the web W on the parent roll 40*b* to indicate a beginning position or seam point of the web W (note:

the beginning position may or may not be the tail T).

Hot-melt glue, double-sided tape, a compression, a mechanical tie, or similar adhesive is applied to hold the prepared tail T to the parent roll 40*b* so that the wind effects do not unwind the web W when the parent roll 40*b* is accelerated by the primary unwind system 20.

The parent roll 40*b* is driven up to the current machine speed by the primary center-drive system 20.

The parent roll 40*b* start position is tracked with the marker 88, and the secondary drive unwind system 70 is lowered to touch the running web W of parent roll 48 to a surface of the parent roll 40*b* at the appropriate time.

Figure 12:
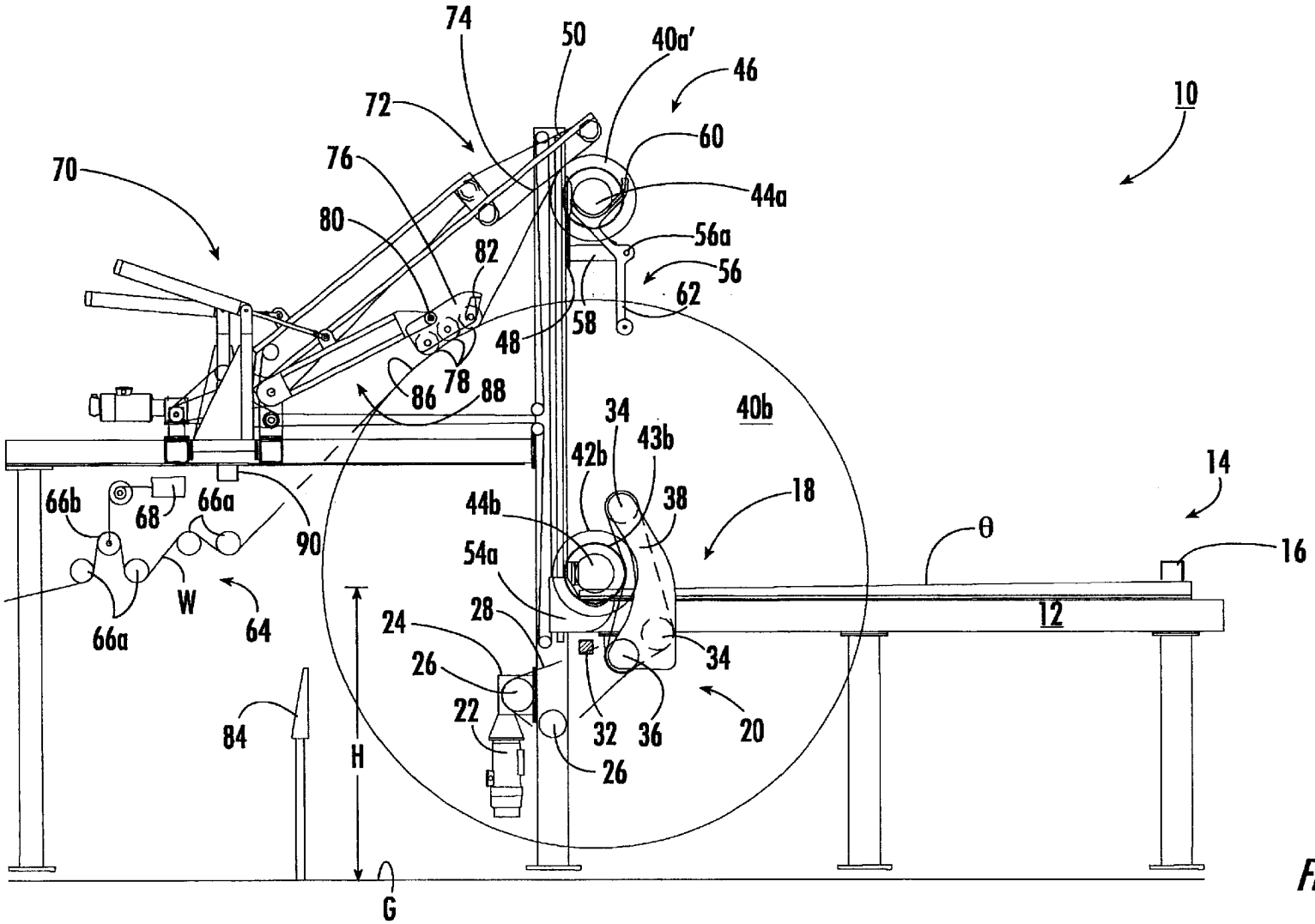
FIG. 12 is an elevational view similar to FIG. 11 in which a knife and roller arm of the secondary drive unwind system is shown sealing a web of the new parent roll and the web of the unwinding parent roll together.

As shown in FIG. 12, the knife and roller arm 76 engages the web W of parent roll 40*a*' with its idler rolls 78 to press and seal the web W of parent roll 40*a*' against the web W of parent roll 40*b*. The hot-melt spray application or double-sided tape will stick the two webs W together. The resulting splice zone or seam 86 is marked by the marker 88 and tracked to indicate when to cut the two webs W at the appropriate position and time downstream.

In the example illustrated in FIG. 12, a knife 82 is installed on the knife and roller arm 76 to cut the web W precisely; however, the web W can simply be broken by stopping the parent roll 40*a*'. In either case, the remaining web W of parent roll 40*a*' is rewound at the first vertical end position 50 and parent roll 40*a*' removed. This arrangement eliminates roll change delays since a flying-splice occurs at full system operating speed.

Figure 13:
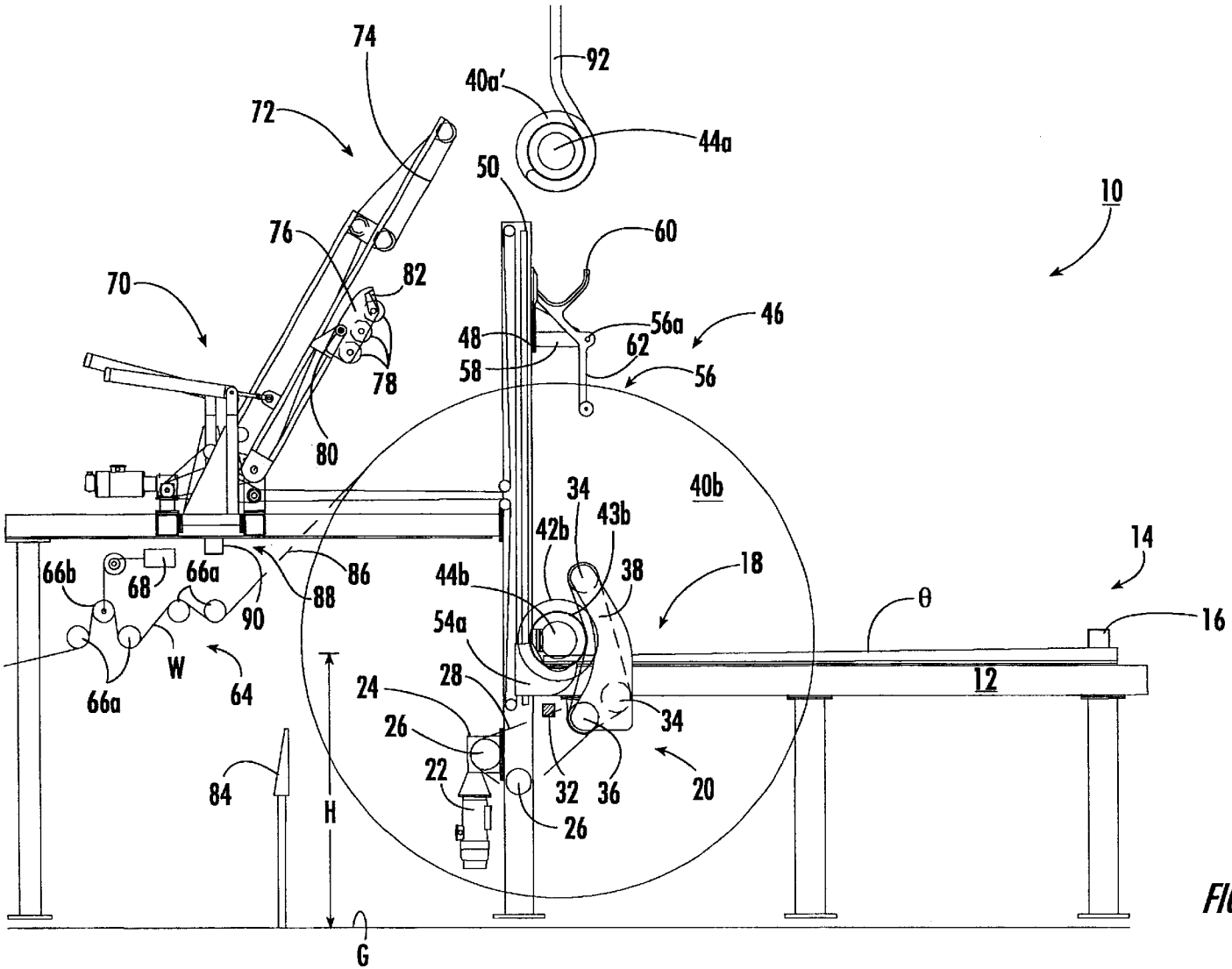
FIG. 13 is an elevational view similar to FIG. 12 showing the unwound parent roll being removed from the unwind system according to an aspect of the invention.

As shown in FIG. 13, the flag 88 is registered by the tracking device 90 and tracked through the tissue machine for automatic removal at a reject station (not shown) downstream. The device 90 may be an electronic or photographic eye, or alternative tracking mechanisms such as timing devices or surface sensors.

Further shown in FIG. 13, the unwind arm 72 and knife and roller arm 76 are both retracted once the flying-splice has been accomplished. An overhead hoist or hoist hook mechanism 92 removes the spent parent roll 40*a*'. It is to be noted that a hoist 92 is not meant as a limitation of the invention. Alternative roll removal systems such as a separate ramp and conveyor system for removal of the spent parent roll 40*a*' can be suitably used.

Figure 14:
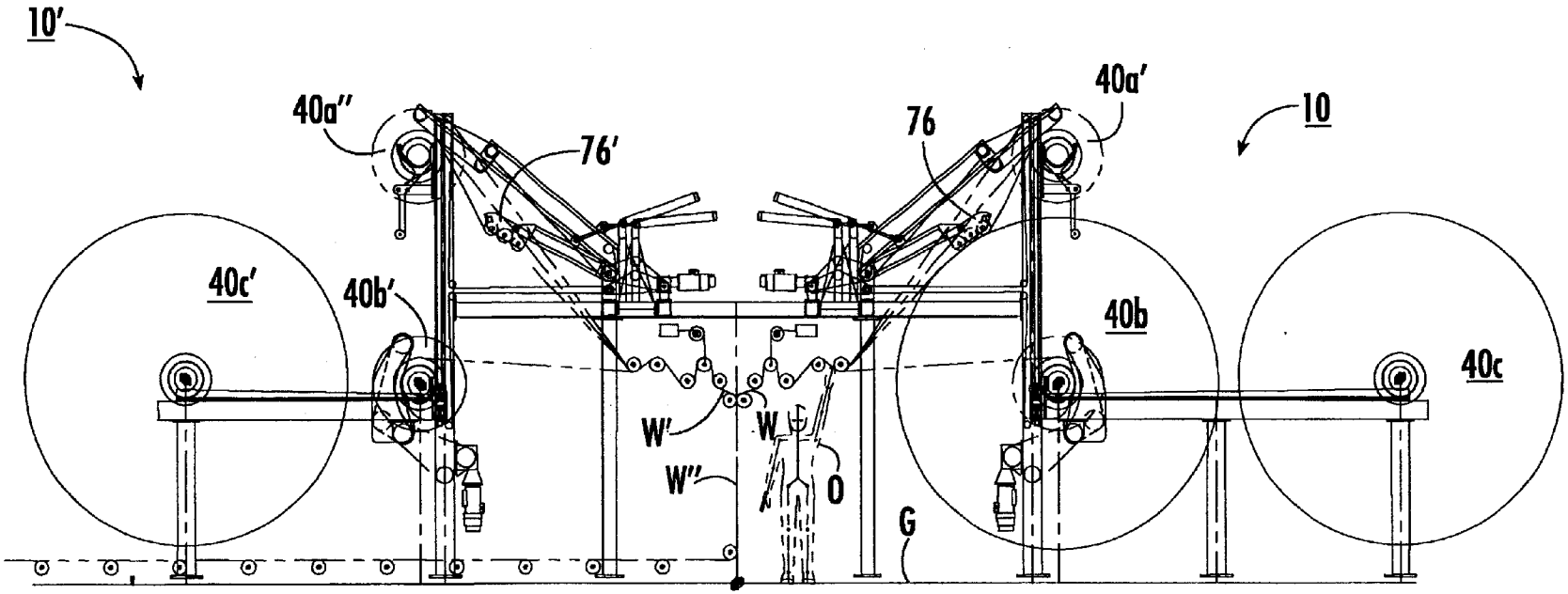
FIG. 14 is an elevational view of another aspect of the invention.

Referring now to FIG. 14, an alternative embodiment of the invention is shown. The unwind system 10 as generally previously described is shown arranged in-line with an unwind system 10'. The unwind systems 10,10' cooperate to unwind two or more parent rolls to create a two-ply product such as tissues, paper towels and the like using a flying splice unwind process, also as generally described in the foregoing embodiment.

More particularly, FIG. 14 shows, for instance, the knife and roller arm 76 of the unwind system 10 engaging the web W of the parent roll 40*a*' and splicing the web W against the web W of parent roll 40*b* on the fly as described in the previous embodiment. Simultaneously, a web W' from the parent roll 40*a*" of the unwind system 10' is spliced with the web W from the unwind system 10 to form a two-ply web W". At any time, a new parent roll such as parent rolls 40*c*, 40*c*' can be inserted together or individually as needed. This arrangement eliminates roll change delays when creating a two-ply product on the fly at full system operating speed.

Figure 15:
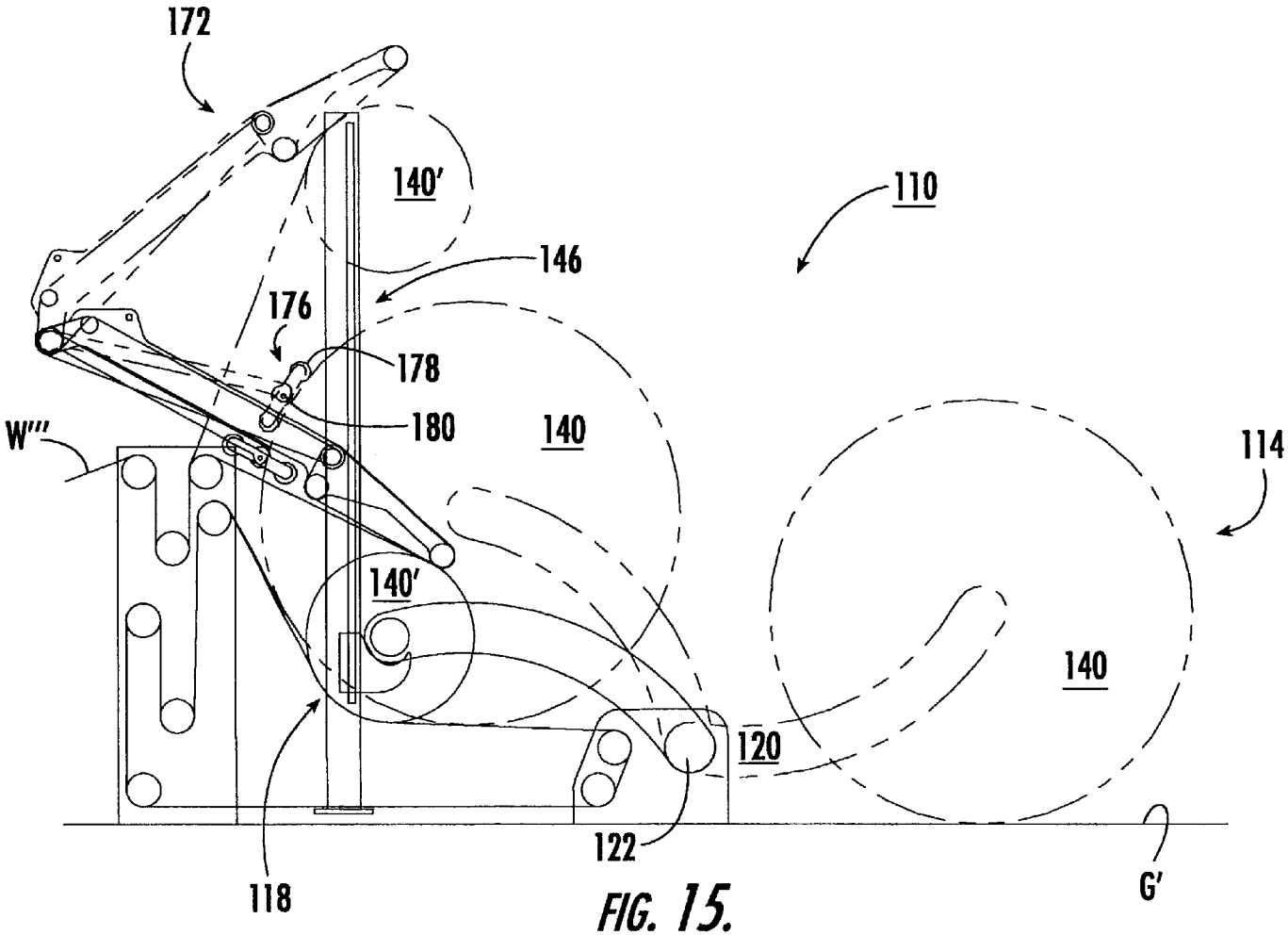
FIG. 15 is a simplified elevational view of a further aspect of the invention.

FIG. 15 shows another embodiment of the invention. In this aspect, a parent roll 140 is positioned at a staging area 114 of an unwind system 110 at or near a ground level G', or on a raised platform or table. At a predetermined time, the unwind system 110 engages the parent roll 140 in the staging area 114 with a positioning arm 120. The positioning arm 120, in cooperation with a pivot system 122, positions the parent roll 140 in a run position 118. Further operation of the unwind system 110 is similar to the foregoing embodiment. For instance, as FIG. 15 shows, the parent roll 140' (derived from the parent roll 140) is subsequently engaged by an unwind arm 172 and a knife and roller arm 176. The unwinding parent roll 140' is eventually removed from the run position 118 for receipt of another parent roll (not shown). FIG. 15 also particularly shows the roller 178 of the knife and roller arm 176 self-aligning on the parent roll 140. This self-aligning aspect is similar to the previous embodiments.

Figure 16:
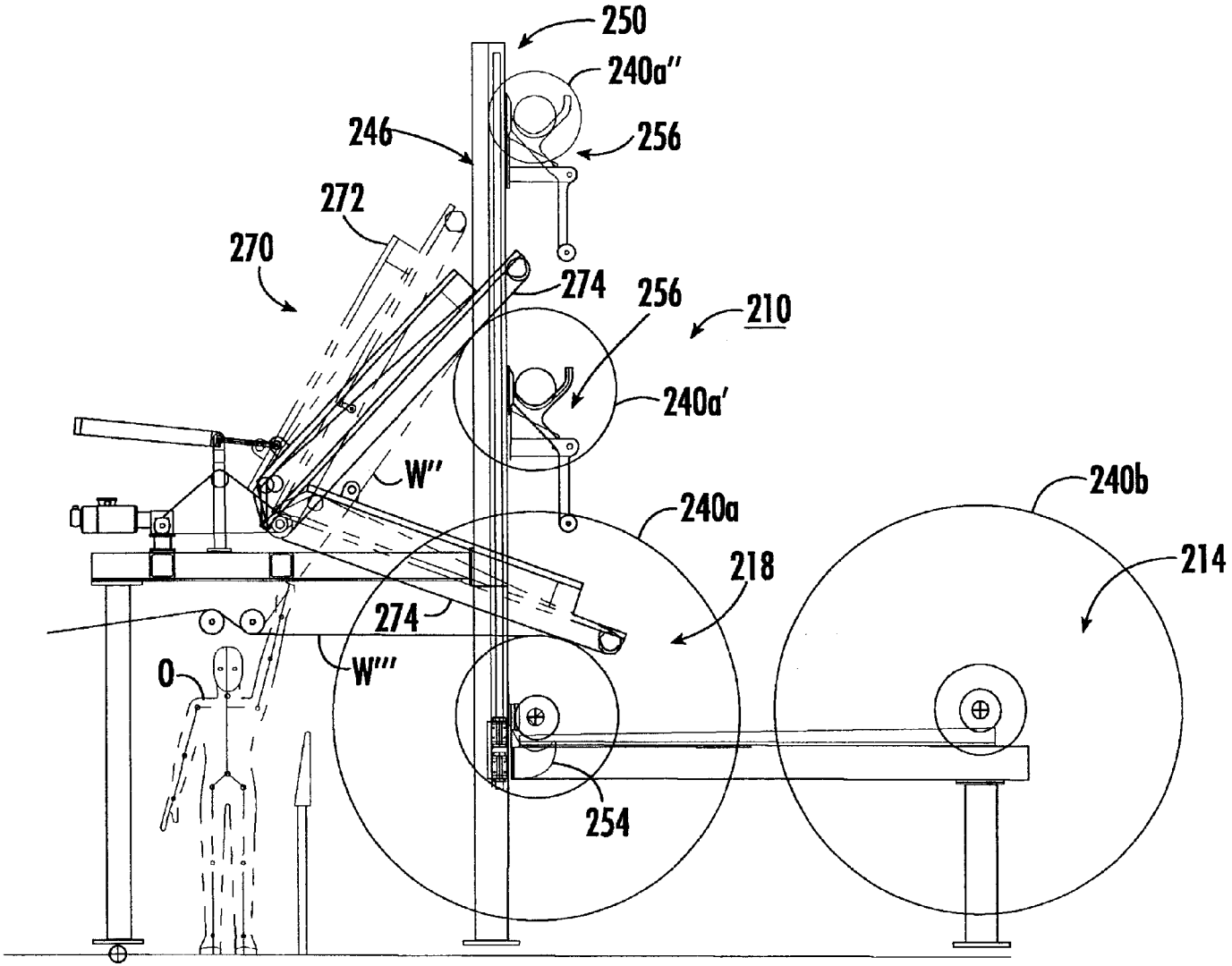
FIG. 16 is an elevational view of another aspect of the invention.

FIG. 16 shows an unwind, designated in general by the numeral 210, which is provided to eliminate down time for positioning new parent rolls 240*a,b*. The unwind 210 includes an elevator assembly 246 and an unwind drive system 270 that operate in a manner similar to the foregoing embodiments. In this aspect, however, the parent roll 240*b* is staged in a staging area 214 while the parent roll 240*a* is unwound at the primary unwind position 218 by an unwind arm 272 of the unwind drive system 270. More particularly, the surface-drive belt 274 immediately engages the parent roll 240*a* to unwind its web W" in the primary unwind position 218. In comparison, the primary unwind drive 20 of the foregoing embodiment (see, e.g., FIG. 2) initially unwinds the parent roll 40*a* before the unwind drive system 70 engages the unwinding parent roll 40*a*' (see FIG. 6).

As FIG. 16 shows, the surface-drive belt 274 of the unwind arm 272 remains engaged with the parent roll 240*a* and continues to unwind the web Wiv throughout the unwinding process as the parent roll 240*a* unwinds to a smaller roll 240*a*'. Also shown in FIG. 16 and similar to exemplary operations previously described, the parent roll 240*a*' continues to unwind until the unwound parent roll 240" engages a hinged latch assembly 256 for eventual removal from the unwind 210. Meanwhile, as the hinged latch assembly 256 is elevating the parent roll 240", the new parent roll 240*b* is repositioned from the staging area 214 t0 the primary unwind position 218. In this aspect of the invention, the operator O would require a short down time (about less than 1 minute), for example, to jog the parent roll 240*b* into position 218 and prepare a tail (not shown) of the parent roll 218. Otherwise, operation of the unwind 210 is similar to the previous embodiments.

In light of the foregoing description, it will be apparent to those skilled in the art that various modifications and variations can be made in the present invention without departing from the spirit and scope of the invention. For example, additional parent rolls may be added at additional staging areas of an extended kitchen rail, and additional kitchen rails can be added parallel to existing kitchen rails. The parent roll drive type can be a flexible combination of one or more center-drives and surface-belt drives located between the floor and the parent roll and/or above the parent roll. Furthermore, the illustrated vertical orientation of the elevator assembly 46 may be modified to extend from between about 30 degrees to about 100 degrees. Of course, specific shapes of various elements of the illustrated embodiments may be altered to suit particular applications. It is intended, therefore, that the present invention include such modifications and variations as come within the scope of the appended claims and their equivalents.

What is claimed is:

1. A roll unwinding system comprising:

a kitchen rail configured for positioning at least one parent roll;

a drive assembly operably disposed proximate the kitchen rail, the drive assembly configured for controllably unwinding a first material from the at least one parent roll; and an elevator assembly operably disposed adjacent the kitchen rail and the drive assembly, the elevator assembly configured to reposition the at least one parent roll at a predetermined time and receive a second parent roll with a second material, the drive assembly and the elevator assembly cooperable to splice the first and second materials together on the fly.

2. The unwinding system as in claim 1, wherein the kitchen rail includes a park position and a run position, the park position disposed at a distance from a ground level greater than the run position, the park position configured for staging the at least one parent roll.

3. The unwinding assembly as in claim 2, wherein the park position is disposed from between about 0.5 degrees to about 1.5 degrees above the run position such that the at least one parent roll is urged in a direction of the run position by a force of gravity.

4. The unwinding system as in claim 1, wherein the drive assembly includes a center-drive arm configured to pivot against a drive sprocket of a coreshaft, the coreshaft removably disposed in a core of the at least one parent roll, the center-drive arm further configured to rotatably hold the at least one parent roll adjacent the elevator assembly.

5. The unwinding system as in claim 4, wherein the center-drive arm includes a timing belt configured to grippingly rotate the drive sprocket of the coreshaft to rotate the parent roll.

6. The unwinding system as in claim 4, wherein the coreshaft extends through the core and defines a width greater than a width of the at least one parent roll, the center-drive arm disposed within the width of the coreshaft.

7. The unwinding system as in claim 6, wherein the coreshaft is two coreshafts, the core defining two opposing ends, the two coreshafts disposed at respective opposing ends.

8. The unwinding system as in claim 6, wherein the width of the at least one parent roll is from between about 60 inches to about 150 inches.

9. The unwinding system as in claim 4, wherein the center-drive arm is pivoted by one of a pneumatic positioning cylinder, a hydraulic device, an electrical device, and a mechanical device.

10. The unwinding system as in claim 4, wherein the coreshaft includes an air bladder configured to expandably grip the core.

11. The unwinding system as in claim 1, wherein the elevator assembly includes a rail configured for slidable movement of the at least one parent roll.

12. The unwinding system as in claim 1, wherein the elevator assembly includes an elevator arm configured to move the at least one parent roll in a direction away from the primary drive position at the predetermined time.

13. The unwinding system as in claim 12, wherein the elevator arm is pivotably configured to deliver the at least one parent roll to a latch assembly disposed at an end of the elevator assembly for a secondary unwinding process.

14. The unwinding system as in claim 12, further comprising a hinged latch assembly disposed at an end of the elevator assembly in a direction away from the drive assembly, the elevator arm configured to move past the hinged latch assembly in the direction away from the drive assembly, the hinged latch assembly configured to pivot apart from the moving elevator arm and returningly pivot to receive the at least one parent roll for a secondary unwinding process.

15. The unwinding system as in claim 14, the hinged latch assembly further comprising a cradle and a counterweight, the cradle configured to releasably hold the at least one parent roll, the counterweight configured to returningly pivot the hinged latch assembly to a resting position.

16. The unwinding assembly as in claim 14, wherein the hinged latch assembly is configured to electronically pivot to releasably hold the at least one parent roll.

17. The unwinding assembly as in claim 1, further comprising a release latch operably attached to the kitchen rail and configured to stage one of the at least one parent roll and the second parent roll, the release latch further configured to release one of the at least one parent roll and the second parent roll in a direction of the drive assembly at the predetermined time.

18. The unwinding system as in claim 1, wherein one of the at least one parent roll and the second parent roll is positioned by one of mechanical, electrical and gravity devices.

19. The unwinding assembly as in claim 1, wherein the walk-up height is from about 50 inches to about 100 inches above a ground level, the unwinding system disposed proximate the ground level.

20. The unwinding system as in claim 1, further comprising a secondary unwind drive assembly configured to unwind the at least one parent roll at the predetermined time, the secondary unwind drive assembly configured to reposition and continuously drive the at least one parent roll as the elevator assembly moves the parent roll in a direction away from the primary drive position.

21. The unwinding system as in claim 20, wherein the secondary unwind drive assembly engages the at least one parent roll based on one of a preset time, a sensed parent roll diameter, and a manual engagement.

22. The unwinding system as in claim 20, wherein the secondary unwind drive assembly includes a surface-drive belt configured to unwind the at least one parent roll.

23. The unwinding system as in claim 20, wherein the secondary unwind drive assembly further comprises a knife and roller arm assembly configured to engage the at least one parent roll to seal a portion of the first web material to the second web material, the knife configured to sever the parent roll from the new parent roll.

24. The unwinding system as in claim 23, wherein the knife and roller arm assembly includes from between about one roller to about five rollers, the rollers configured to pivotably self-align on the second parent roll to seal the portion to the second parent roll.

25. The unwinding system as in claim 23, further comprising a marker disposable proximate the portion and configured to mark a seam between the first and second materials.

26. The unwinding system as in claim 25, further comprising a sensor in communication with the knife and roller arm assembly, the sensor configured to sense the marker and control a knife of the knife and roller assembly to sever the at least one parent roll from the second parent roll.

27. The unwinding system as in claim 1, further comprising means for positioning a tail of the second parent roll for unwinding the second parent roll.

28. The unwinding system as in claim 27, wherein the means for positioning is selected from the group consisting of a vacuum device, a blower device, a clamping device and combinations thereof.

29. The unwinding system as in claim 1, further comprising a hoisting mechanism to hoist the at least one parent roll from the elevator assembly after the at least one parent roll is unwound.

30. The unwinding system as in claim 1, further comprising a ramp and conveyor assembly to remove the core from the elevator assembly after the at least one parent roll is unwound.

31. The unwinding system as in claim 1, further comprising an idler roller system configured to trim a speed of the at least one parent roll as the at least one parent roll unwinds.

32. The unwinding system as in claim 31, wherein the idler roller system includes a dancer roll configured to maintain a tension of the first material, the dancer roll in controllable communication with a motor driving the drive assembly, the dancer roll configured to decrease a speed of the motor when the tension decreases and to increase the speed of the motor when the tension increases.

33. The unwinding system as in claim 1, wherein one of the first and second materials are selected from the group consisting of a tissue, a paper product, an industrial wiper, a laboratory wiper, a wet wipe, a non-woven polymer material, an airlaid material, a wet material, a dry material, a disposable material, a non-disposable material, a treated material and combinations thereof.

34. An unwinding system comprising:

a positioning device configured for staging and operably positioning a parent roll;

a drive assembly operably disposed adjacent the positioning device and configured for controllably unwinding the parent roll during an unwinding process;

an elevator assembly operably disposed adjacent the positioning device and drive assembly and configured to reposition the parent roll at a predetermined stage in the unwinding process; and a secondary unwind drive assembly configured to further unwind the parent roll at the predetermined stage.

35. The unwinding system as in claim 34, wherein the positioning device includes a parent roll park position and a run position, the park position disposed above the run position.

36. The unwinding system as in claim 35, wherein the park position is disposed from between about 0.5 degrees to about 1.5 degrees above the run position such that the parent roll is urged in a direction of the run position by a force of gravity.

37. The unwinding system as in claim 35, wherein the drive assembly includes an adjustable center-drive arm configured to pivot against a drive sprocket of a coreshaft, the coreshaft removably disposed in a core of the parent roll, the adjustable center-drive arm further configured to rotatably hold the parent roll adjacent the elevator assembly.

38. The unwinding system as in claim 37, wherein the coreshaft extends through the parent roll core and defines a width greater than a width of the parent roll, the adjustable center-drive arm disposed within the width of the coreshaft.

39. The unwinding system as in claim 38, wherein the coreshaft is two coreshafts, and the parent roll core defines two ends, the two coreshafts respectively disposed at each of the two ends.

40. The unwinding system as in claim 38, wherein the adjustable center-drive arm is pivoted by one of a pneumatic positioning cylinder, a hydraulic device, an electrical device and a mechanical device.

41. The unwinding system as in claim 38, wherein the coreshaft includes an expandable air bladder configured to grip the parent roll core.

42. The unwinding system as in claim 34, wherein the elevator assembly includes an elevator arm configured to vertically move the parent roll in a direction away from the drive assembly at the predetermined stage.

43. The unwinding system as in claim 42, wherein the elevator arm is pivotably configured to deliver the parent roll to a latch assembly disposed at an end of the elevator assembly for a secondary unwinding process.

44. The unwinding system as in claim 42, further comprising a hinged latch assembly disposed at an end of the elevator assembly in a direction away from the drive assembly, the elevator arm configured to vertically move past the hinged latch assembly in the direction away from the drive assembly, the hinged latch assembly configured to pivot apart from the moving elevator arm and returningly pivot to receive the parent roll for a secondary unwinding process.

45. The unwinding system as in claim 44, the hinged latch assembly further comprising a cradle to releasably hold the parent roll and a counterweight configured to returningly pivot the hinged latch assembly.

46. The unwinding system as in claim 44, wherein the hinged latch assembly is configured to electronically pivot to releasably hold the parent roll.

47. The unwinding system as in claim 34, further comprising a release latch operably attached to the positioning device, the release latch configured to stage the parent roll and further configured to release the staged parent roll in a direction of the drive assembly at the predetermined stage.

48. The unwinding system as in claim 34, wherein the parent roll is positioned by one of mechanical, electrical, and gravity devices.

49. The unwinding system as in claim 34, wherein the secondary unwind drive assembly is further configured to reposition and continuously drive the parent roll as the elevator assembly moves the parent roll from a first end of the elevator assembly to a second end of the elevator assembly.

50. The unwinding system as in claim 49, wherein the secondary unwind drive assembly includes a surface-drive belt configured to further unwind the parent roll.

51. The unwinding system as in claim 49, wherein the secondary unwind drive assembly further comprises a knife and roller arm assembly configured to engage the parent roll and seal a portion of the parent roll to a second parent roll, the knife configured to sever the parent roll from the second parent roll.

52. The unwinding system as in claim 51, wherein the knife and roller arm assembly includes from between one roller to about five rollers, the rollers configured to pivotably self align on the second parent roll to seal the portion to the second parent roll.

53. The unwinding system as in claim 34, wherein the parent roll is a web material, an airlaid material, a wet material, a dry material, a disposable material, a non-disposable material, a treated material and combinations thereof.

54. The unwinding system as in claim 53, further comprising a marker disposed between a web of the parent roll and a web of the second parent roll, the marker configured to mark a seam between the two webs.

55. The unwinding system as in claim 54, wherein the seam is made by one of an adhesive, a double-sided tape, a compression, a mechanical tie, and combinations thereof.

56. The unwinding system as in claim 55, further comprising an electronic eye in communication with the knife and roller arm assembly and configured to sense the marker, the electronic eye further configured to control a knife of the knife and roller assembly to sever the parent roll from the second parent roll.

57. The unwinding system as in claim 34, further comprising a second parent roll having a second tail and means for positioning the second tail for unwinding of the second parent roll.

58. The unwinding system as in claim 57, wherein the means for positioning is selected from the group consisting of a vacuum device, a blower device, a clamping device and combinations thereof.

59. The unwinding system as in claim 34, further comprising a hoisting mechanism to hoist the parent roll from the elevator assembly following the unwinding process.

60. The unwinding system as in claim 34, further comprising a ramp and conveyor assembly to remove the parent roll from the elevator assembly following the unwinding process.

61. The unwinding system as in claim 34, further comprising an idler roller system configured to trim a speed of the unwinding parent roll.

62. The unwinding system as in claim 34, further comprising another drive assembly disposed on an opposite side of the parent roll from the drive assembly and cooperably configured to square the parent roll for unwinding.

63. The unwinding system as in claim 34, further comprising an assist device cooperably configured to assist the drive assembly in squaring the parent roll for unwinding.

64. The unwinding system as in claim 34, further comprising a surface-belt unwinder.

65. A method of unwinding a roll of web material with a flying-splice, the method comprising the steps of:

a. positioning a first roll of web material in a run position;

b. rotating the first roll to unwind the web material with an unwinder;

c. removing the first roll at a predetermined stage from the run position while continuously unwinding the web material from the first roll with a secondary unwinder;

d. positioning a second roll of web material proximate the removed first roll;

e. rotating the second roll to unwind the web material from the second roll;

f. splicing the web material of the first roll to the web material of the second roll at a machine speed; and g. removing the first roll from the unwinder.

66. The method of unwinding a roll as in claim 65, wherein the first roll is positioned on a kitchen rail, the kitchen rail including a park position and a run position, the park position disposed above the run position.

67. The method of unwinding a roll as in claim 66, wherein the park position is disposed from between about 0.5 degrees to about 1.5 degrees above the run position such that one of the first and second rolls is urged in a direction of the run position by a force of gravity.

68. The method of unwinding a roll as in claim 66, wherein the unwinder includes a center-drive arm configured to pivot against a drive sprocket of a coreshaft, the cores haft removably disposed in a core of one of the first and second rolls, the center-drive arm further configured to rotatably hold one of the first and second rolls adjacent an elevator assembly.

69. The method of unwinding a roll as in claim 68, wherein the center-drive arm is pivoted by one of a pneumatic positioning cylinder, a hydraulic device, an electrical device and a mechanical device.

70. The method of unwinding a roll as in claim 69, wherein the coreshaft extends through the core and defines a width greater than a width of one of the first and second rolls, the center-drive arm disposed within the width of the coreshaft.

71. The method of unwinding a roll as in claim 70, wherein the coreshaft is two coreshafts, and the core defines two ends, the two coreshafts respectively disposed at each of the two ends.

72. The method of unwinding a roll as in claim 70, further comprising the steps of inserting an air bladder between the core and the coreshaft and expanding the air bladder such that the coreshaft grips the core.

73. The method of unwinding a roll as in claim 65, further including the step of moving the first roll with an elevator arm of an elevator assembly in a direction away from the unwinder at the predetermined stage.

74. The method of unwinding a roll as in claim 73, wherein the elevator arm is pivotably configured to deliver the first roll to a latch assembly disposed at an end of the elevator assembly for a secondary unwinding process.

75. The method of unwinding a roll as in claim 73, further comprising a hinged latch assembly disposed at an end of the elevator assembly in a direction away from the unwinder, the elevator arm configured to move past the hinged latch assembly in the direction away from the unwinder, the hinged latch assembly configured to pivot apart from the moving elevator arm and returningly pivot to receive the first roll for a secondary unwinding process.

76. The method of unwinding a roll as in claim 75, wherein the hinged latch assembly further comprises a cradle and a counterweight, the cradle configured to releasably hold the first roll, the counterweight configured to returningly pivot the hinged latch assembly to a resting position.

77. The method of unwinding a roll as in claim 75, further comprising the step of pivoting the hinged latch assembly selected from the group consisting of an electronic step, a mechanical step, a pneumatic step, a manual step, a gravitational step and combinations thereof.

78. The method of unwinding a roll as in claim 65, further comprising the steps of staging the first roll in a stage area on a kitchen rail and releasing the staged first roll in a direction of the unwinder with a release latch operably attached to the kitchen rail.

79. The method of unwinding a roll as in claim 65, wherein the first roll is positioned by one of mechanical, electrical and gravity devices.

80. The method of unwinding a roll as in claim 65, further comprising the step of further unwinding the first roll at the predetermined stage using a secondary unwind drive assembly.

81. The method of unwinding a roll as in claim 80, wherein the secondary unwind drive assembly includes a surface-drive belt configured to further unwind the first roll.

82. The method of unwinding a roll as in claim 81, wherein the secondary unwind drive assembly further comprises a knife and roller arm assembly configured to engage the first roll and seal a portion of the first roll to the second roll, the knife configured to sever the first roll from the second roll.

83. The method of unwinding a roll as in claim 82, wherein the knife and roller arm assembly includes from between about one roller to about five rollers, the rollers configured to pivotably self-align on the second roll to seal the portion to the second roll.

84. The method of unwinding a roll as in claim 82, further comprising the step of marking a seam between the first roll and the second roll with a marker.

85. The method of unwinding a roll as in claim 84, wherein the seam is made by one of an adhesive, a double-sided tape, a compression, a mechanical tie, and combinations thereof.

86. The method of unwinding a roll as in claim 84, further comprising an electronic eye in communication with the knife and roller arm assembly and configured to sense the marker, the electronic eye further configured to control a knife of the knife and roller assembly to sever the first roll from the second roll.

87. The method of unwinding a roll as in claim 65, further comprising means for positioning a tail of the second roll for unwinding the second roll.

88. The method of unwinding a roll as in claim 87, wherein the means for positioning is selected from the group consisting of a vacuum device, a blower device, a clamping device and combinations thereof.

89. The method of unwinding a roll as in claim 65, further comprising the step of hoisting the first roll from the elevator assembly following the unwinding step.

90. The method of unwinding a roll as in claim 65, further comprising the step of removing the first roll from the elevator assembly following the unwinding step with a ramp and conveyor assembly.

91. The method of unwinding a roll as in claim 65, further comprising the step of trimming a speed of the unwinding first roll with an idler roller system.

92. The method of unwinding a roll as in claim 65, wherein one of the first and second rolls is a web material selected from the group consisting of a tissue, a paper product, a non-woven polymer material, an airlaid material, a wet material, a dry material, a disposable material, a non-disposable material, a treated material and combinations thereof.

93. The method of unwinding a roll as in claim 65, further comprising the step of assisting the unwinder to unwind the first roll using a surface-belt unwinder.

94. The method of unwinding a roll as in claim 65, wherein the unwinder is a center-drive unwinder.

95. A method of unwinding sequential rolls of web material to eliminate machine down time for positioning parent rolls, the method comprising the steps of:

a. positioning a first roll of web material in a run position of a machine;

b. rotating the first roll to unwind the web material with an unwinder;

c. removing the first roll at a predetermined stage from the run position while continuously unwinding the web material from the first roll with the unwinder;

d. positioning a second roll of web material proximate the removed first roll;

e. stopping the machine to splice web material from the first roll to the second roll;

f. raising the unwinder to remove the first roll; and g. lowering the unwinder to drive the second roll of web material.

96. The method of unwinding a roll as in claim 95, wherein the unwinder includes a pivoting unwind arm surface belt assembly.

97. The method of unwinding a roll as in claim 95, further including the step of moving the first roll with an elevator arm of an elevator assembly in a direction away from the unwinder at the predetermined stage.

98. The method of unwinding a roll as in claim 95, further comprising the substep of re-starting the machine after the unwinder is lowered.

99. An unwinding system comprising:

a surface belt unwind drive assembly configured to unwind a parent roll at a primary run position; and an elevator assembly operably disposed proximate the unwind drive assembly and primary run position, the elevator assembly configured to reposition the parent roll at a predetermined stage, the surface belt unwind drive assembly further configured to reposition and continuously drive the parent roll as the elevator assembly moves the parent roll from the primary run position to an end of the elevator assembly disposed above the primary run position.

100. The unwinding system as in claim 99, further comprising a positioning device configured for staging and positioning the parent roll in the primary run position.

* * * * *

UNITED STATES PATENT AND TRADEMARK OFFICE

CERTIFICATE OF CORRECTION

PATENT NO. : 6,820,837 B2
DATED : November 23, 2004
INVENTOR(S) : Leslie T. Long It is certified that error appears in the above-identified patent and that said Letters Patent is hereby corrected as shown below:

Title page,
Item [56], References Cited, OTHER PUBLICATIONS, "English Language Patent Abstract of JP Publication No. 11310358" should have Publication Date of -- November 9, 1999. --.

Column 17,
Line 7, please delete "cores haft" and insert therefor -- coreshaft --.

Signed and Sealed this

Twenty-fifth Day of October, 2005

JON W. DUDAS
*Director of the United States Patent and Trademark Office*